US011664598B2

(12) United States Patent
Leung et al.

(10) Patent No.: US 11,664,598 B2
(45) Date of Patent: May 30, 2023

(54) OMNIDIRECTIONAL DIELECTRIC RESONATOR ANTENNA

(71) Applicant: CITY UNIVERSITY OF HONG KONG, Kowloon (HK)

(72) Inventors: Kwok Wa Leung, Kowloon (HK); Xi-Yao Liu, Sham Shui Po (HK); Nan Yang, Kowloon (HK)

(73) Assignee: CITY UNVIERSITY OF HONG KONG, Kowloon (HK)

( * ) Notice: Subject to any disclaimer, the term of this patent is extended or adjusted under 35 U.S.C. 154(b) by 0 days.

(21) Appl. No.: 17/233,401

(22) Filed: Apr. 16, 2021

(65) Prior Publication Data

US 2022/0336954 A1 Oct. 20, 2022

(51) Int. Cl.
*H01Q 9/04* (2006.01)
*H01Q 1/48* (2006.01)

(52) U.S. Cl.
CPC ..... *H01Q 9/045* (2013.01); *H01Q 1/48* (2013.01); *H01Q 9/0464* (2013.01)

(58) Field of Classification Search
CPC ..... H01Q 1/38–48; H01Q 9/04; H01Q 9/0485
See application file for complete search history.

(56) References Cited

U.S. PATENT DOCUMENTS

2021/0066816 A1* 3/2021 Leung ..... H01Q 1/50

* cited by examiner

*Primary Examiner* — Hasan Islam

(57) ABSTRACT

The present disclosure includes an omnidirectional dielectric resonator antenna (DRA). The omnidirectional DRA comprises a substrate, a dielectric, and a planar antenna positioned between the substrate and the dielectric. The planar antenna comprises a central planar feed positioned on the substrate. The planar antenna also comprises a plurality of feed lines coupled to, and extending outward from, the central planar feed. The planar antenna also comprises a plurality of arms coupled to the plurality of feed lines. Each arm extends from a corresponding feed line.

20 Claims, 16 Drawing Sheets

600

700

1100

2600

2600

2700

2800

OMNIDIRECTIONAL DIELECTRIC RESONATOR ANTENNA

CROSS-REFERENCE TO RELATED APPLICATIONS

None.

STATEMENT REGARDING FEDERALLY SPONSORED RESEARCH OR DEVELOPMENT

Not applicable.

BACKGROUND

An antenna is a metallic structure that captures and/or transmits electromagnetic waves. Antennas are used in a broad range of wireless communication applications. In the telecommunications industry, companies constantly attempt to shrink end user hardware as well and attempt to cut manufacturing costs. As such, there is constant pressure to reduce both the size and complexity of antennas. Further, telecommunications systems are under significant reliability constraints. Accordingly, antennas should be reduced in size and complexity while increasing, or at least not significantly decreasing, transmission capabilities.

SUMMARY

In an example, an omnidirectional dielectric resonator antenna (DRA) is disclosed. The omnidirectional DRA comprises a substrate, a dielectric, and a planar antenna positioned between the substrate and the dielectric. The planar antenna comprises a central planar feed positioned on the substrate; a plurality of feed lines coupled to, and extending outward from, the central planar feed; and a plurality of arms coupled to the plurality of feed lines, wherein each arm extends from a corresponding feed line.

In another example, a method of fabricating an omnidirectional DRA is disclosed. The method comprises: printing a central planar feed of a planar antenna onto a substrate; printing a plurality of feed lines of the planar antenna onto the substrate, the plurality of feed lines coupled to, and extending outward from, the central planar feed; printing a plurality of arms of the planar antenna onto the substrate, the plurality of arms coupled to the plurality of feed lines, wherein each arm extends from a corresponding feed line; and attaching a dielectric onto the substrate.

These and other features will be more clearly understood from the following detailed description taken in conjunction with the accompanying drawings and claims.

BRIEF DESCRIPTION OF THE DRAWINGS

It will be convenient to further describe the present invention with respect to the accompanying drawings that illustrate possible arrangements of the invention, in which like integers refer to like parts. Other embodiments of the invention are possible, and consequently the particularity of the accompanying drawings is not to be understood as superseding the generality of the preceding description of the invention.

DETAILED DESCRIPTION

Figure 1:
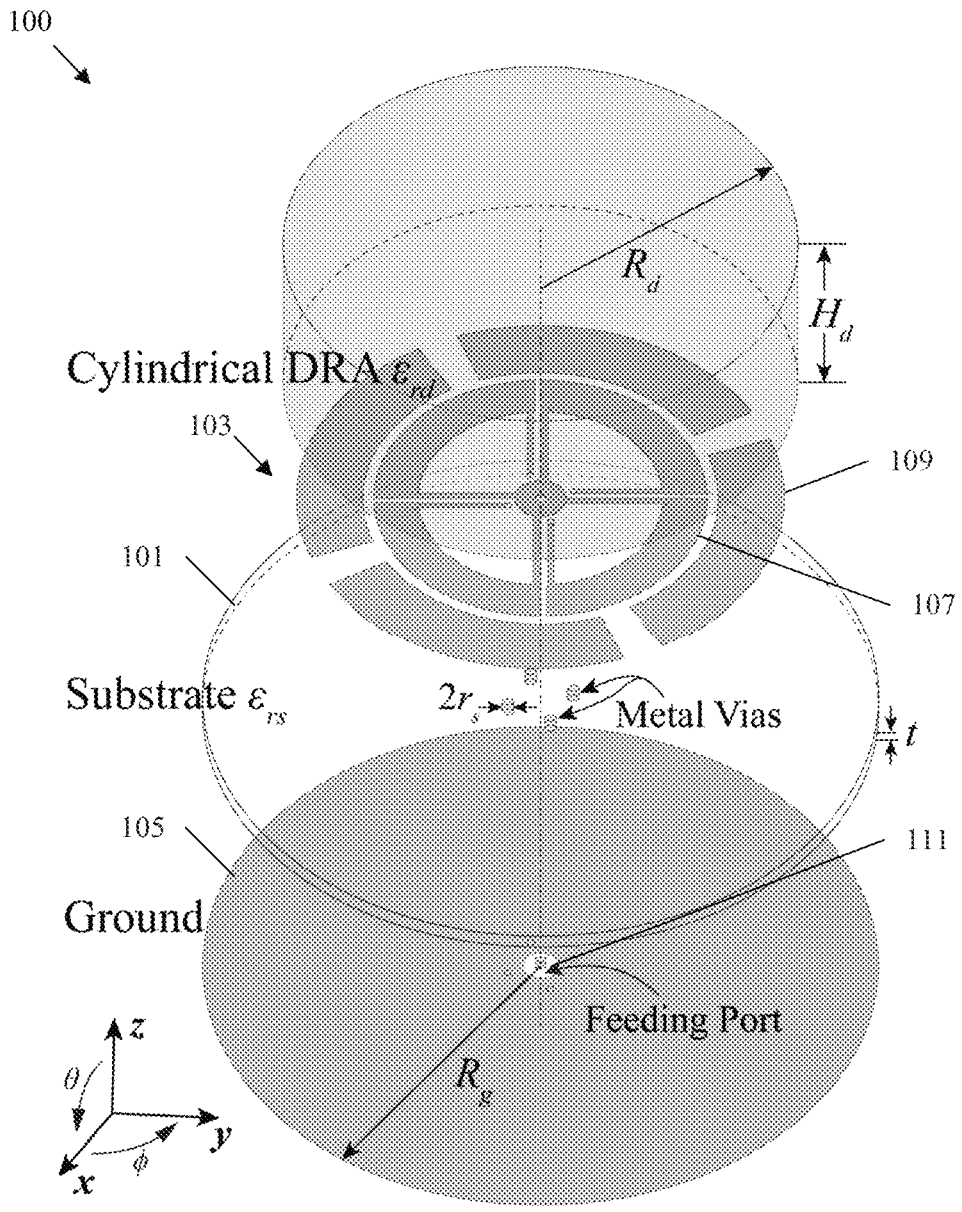
FIG. 1 shows a perspective view of an example of omnidirectional dielectric resonator antenna (DRA)

The current disclosure relates to mechanisms for implementing an antenna, and particularly to mechanisms to implement a wideband horizontally polarized omnidirectional DRA with a polarization-reconfigurable design.

A dielectric resonator antenna (DRA) is a radio antenna that generally includes a dielectric, such as a block of ceramic material, that is designed to function as a resonator for radio waves. The dielectric is mounted onto an antenna, which is in turn mounted onto a metal surface that acts as a ground plane. Radio waves are introduced into the inside of the resonator material from the transmitter circuit. The radio waves bounce back and forth between the resonator walls, which forms standing waves. The walls of the resonator are partially transparent to radio waves, allowing the radio power to radiate into space. DRAs replace metal parts with a dielectric. Such metal parts become lossy and dissipate energy at high frequencies. Hence, DRAs are efficient in comparison to metal antennas. DRAs can be produced for low costs and can be tuned for many different uses. For example, omnidirectional DRAs are useful use as indoor wireless antennas because omnidirectional DRAs provide a large area of signal coverage. However, omnidirectional DRAs generally employ multi-layer feeding substrates and/or multi-segment dielectric resonators. Such designs are complicated and hence can increase production costs. Further, such designs are associated with narrow bandwidths (e.g., only resonate at a small number of possible frequencies).

Disclosed herein is an improved omnidirectional DRA. The disclosed omnidirectional DRA employs simple structures for ease of manufacturing. Further, the disclosed omnidirectional DRA resonates at a wide range of frequencies. In an example, the disclosed omnidirectional DRA is also reconfigurable. For example, diodes may be used to repolarize the antenna to operate in either a vertical polarization or a horizontal polarization, such as the $TE_{01\delta}$ and $TE_{011+\delta}$ modes, respectively.

In an example, the omnidirectional DRA includes a substrate, a dielectric, and a planar antenna positioned between the substrate and the dielectric. The planar antenna comprises a central planar feed positioned on the substrate. The planar antenna also comprises a plurality of feed lines coupled to, and extending outward from, the central planar feed. The planar antenna also comprises a plurality of arms coupled to the plurality of feed lines. Each arm extends from a corresponding feed line, for example in an arc for a circular design or perpendicular to the feed line in a square/rectangular design. The arms can resonate to create the standing waves for the DRA based on the input from the central planar feed via the feed lines. The central planar feed can be connected to an input, such as a coaxial line. In an example, each arm forms an arc of a circle surrounding the central planar feed. Such a circular configuration supports omnidirectional signal transmission. In an example, the plurality of arms includes exactly four arms. However, other numbers of arms may be used within the scope of this disclosure.

In an example, each arm comprises an end-shorted stub extending back toward the central planar feed. For example, each arm may form a quadrant of the circle, and each arm may comprise a feed line and an end-shorted stub. Hence, each end-shorted stub is parallel to, and separated from, a feed line coupled to an adjacent arm. Currents passing into the end-shorted stubs are out of phase with the currents passing through the adjacent feed lines. Hence, the end-shorted stubs act to suppress cross-polar fields that radiate from the feed lines.

In an example, the planar antenna further comprises a plurality of outer strips surrounding the plurality of arms. The plurality of outer strips may be coupled to, but not directly connected to, the plurality of arms. In an example, the plurality of outer strips includes exactly four outer strips. wherein the plurality of outer strips includes four longer outer strips and four shorter outer strips, for a total of eight strips. However, other numbers of strips may be used within the scope of this disclosure. The plurality of outer strips may form a circle surrounding the plurality of arms. The plurality of outer strips may include impedance matching for the antenna, and hence may also improve the bandwidth of the omnidirectional DRA.

In an example, the omnidirectional DRA further comprises a ground plane. The substrate is positioned between the planar antenna by the ground plane. The substrate may also comprise a plurality of metal vias connecting the ground plane to the planar antenna. The omnidirectional DRA may also comprise a plurality of diodes that connect between the ground plane and the arms using the metal vias. For example, each arm may be connected to two diodes. Hence, eight diodes may be employed when four arms are employed. Each arm may include a feed end that connects to a feed line and a stub end that connects to an end-shorted stub. In an example for each arm, the feed end of the arm is connected to the ground plane via a diode. Also for each arm, the stub end of the arm is connected to the ground plane via a diode. The diodes can be configured to switch the planar antenna between a horizontal polarization (e.g., $TE_{011+\delta}$ mode) and a vertical polarization (e.g., $TE_{01\delta}$ mode). In an example, the diodes are positive region, intrinsic region, negative region (PIN) diodes. For example, biasing voltages can be used to switch the diodes into the on state and/or the off state. In an example, when the diodes are in the on state, the arms are shorted to the ground, which excites a vertical polarization (e.g., $TE_{01\delta}$ mode). Further, when the diodes are in the off state, the arms are open (not shorted to ground), which excites a horizontal polarization (e.g., $TE_{011+\delta}$ mode).

In an example, the omnidirectional DRA further comprises a plurality of capacitors. Each capacitor can connect between the ground plane and a corresponding end-shorted stub using a metal via. Accordingly, the omnidirectional DRA may include eight metal vias for diodes and four metal vias for capacitors, for a total of twelve metal vias. However, other numbers of metal vias may be included as desired. The capacitors block direct current (DC) currents between the end shorted stub and the ground plane. Further, the capacitors, like the diodes, can be placed on the ground plane side to avoid interference with the dielectric resonator.

In an example, a method of fabricating the omnidirectional DRA is also disclosed. A central planar feed of a planar antenna is printed onto a substrate. A plurality of feed lines of the planar antenna are also printed onto the substrate. The plurality of feed lines are coupled to, and extend outward from, the central planar feed. A plurality of arms of the planar antenna are also printed onto the substrate. The plurality of arms is connected to the plurality of feed lines. Each arm extends from a corresponding feed line, for example in a circular arc and/or in a line perpendicular to the feed line. In an example, the plurality of arms includes exactly four arms. However, other numbers of arms may be used within the scope of this disclosure. A dielectric is attached to the substrate onto the planar antenna.

In an example, an end-shorted stub can be printed into each arm prior to attaching the dielectric. Each end-shorted stub may extend toward the central planar feed. Further, each end-shorted stub may be parallel to, and separated from, a feed line coupled to an adjacent arm. For example, each arm may form a quadrant of the circle, and each arm may comprise a feed line and an end-shorted stub. Hence, each end-shorted stub is parallel to, and separated from, a feed line coupled to an adjacent arm. Currents passing into the end-shorted stubs are out of phase with the currents passing through the adjacent feed lines. Hence, the end-shorted stubs act to suppress cross-polar fields that radiate from the feed lines.

In an example, a plurality of outer strips of the planar antenna are printed to surround the plurality of arms. The plurality of outer strips may be coupled to, but not directly connected to, the plurality of arms. In an example, the plurality of outer strips includes exactly four outer strips. wherein the plurality of outer strips includes four longer outer strips and four shorter outer strips, for a total of eight strips. However, other numbers of strips may be used within the scope of this disclosure. The plurality of outer strips may form a circle surrounding the plurality of arms. The plurality of outer strips may include impedance matching for the antenna, and hence may also improve the bandwidth of the omnidirectional DRA.

In an example, the substrate is attached to a ground plane. Each arm can be connected to the ground plane via diodes and meta vias. For example, each arm may be connected to two diodes. Hence, eight diodes may be employed when four arms are employed. Each arm may include a feed end that connects to a feed line and a stub end that connects to an end-shorted stub. In an example for each arm, the feed end of the arm is connected to the ground plane via a diode. Also for each arm, the stub end of the arm is connected to the ground plane via a diode. The diodes can be configured to switch the planar antenna between a horizontal polarization (e.g., $TE_{011+\delta}$ mode) and a vertical polarization (e.g., $TE_{01\delta}$ mode). In an example, the diodes are PIN diodes. For example, biasing voltages can be used to switch the diodes into the on state and/or the off state. In an example, when the diodes are in the on state, the arms are shorted to the ground, which excites a vertical polarization (e.g., $TE_{01\delta}$ mode). Further, when the diodes are in the off state, the arms are open (not shorted to ground), which excites a horizontal polarization (e.g., $TE_{011+\delta}$ mode).

In an example, each end-shorted stub can be coupled to the ground plane via a capacitor and a metal via. The capacitors block direct current (DC) currents between the end shorted stub and the ground plane.

The DRA has a number of advantages such as high efficiency, low cost, and a high degree of flexibility. Omnidirectional DRAs are good candidates for indoor wireless antennas because they provide large signal coverage. For a cylindrical DRA, the $TE_{01\delta}$ and $TM_{01\delta}$ modes as well higher-order modes, such as the $TE_{011+\delta}$ and $TM_{02\delta}$ modes have omnidirectional radiation patterns.

Several curved microstrip arms can be used to excite the $TE_{01\delta}$ and $TE_{011+\delta}$ modes of a cylindrical DRA. This requires that the feed currents on those arms be equal in both amplitude and phase. This also requires a power splitting circuit, which will not only increase the antenna complexity and also undesired cross-polarization. For example, a power dividing circuit can be etched at the bottom of a multilayer substrate to excite the $TE_{011+\delta}$ mode. The −10-dB impedance bandwidth so obtained is about 7.4%. A single substrate with eight feeding strips can be used to excite the $TE_{01\delta}$ mode. However, the DRA is cut into two halves with a hole drilled at the center, complicating the antenna structure. Also, the impedance bandwidth is only about 4.5%. A spoof surface plasmon planar feed has may also excite the $TE_{01\delta}$ mode. The resulting gain variation is undesirably over 5 dB due to the unbalanced feed structure.

Polarization-reconfigurable antennas may be employed for their abilities to mitigate polarization mismatch, reduce signal interference, and enhance channel capacity. Those designs mainly deploy the slot, patch, leaky-wave, dipole, and monopole antennas. DRAs may also be implemented to be reconfigurable. For example, the polarization reconfigurability of the DRAs may be obtained by controlling the distributions of liquids, such as water and ethyl acetate. This approach creates challenges when attempting to improve the switching speed. Also, a careful design is needed to avoid the evaporation and oxidation of the liquids. A second design approach of polarization-reconfigurable DRA is to integrate cross-shaped polarizers with a liquid metal alloy. In this approach, the DRA is split into two halves to accommodate the polarizers, which increases the antenna complexity. Again, this approach creates challenges due to low switching speeds. Several switchable feeding circuits can be used to obtain switchable polarizations. For polarization-reconfigurable DRAs with the same radiation pattern in different states, studies have been limited to broadside-mode designs. No omnidirectional versions are currently known.

In this disclosure, a horizontally polarized omnidirectional DRA is obtained by exciting its $TE_{011+\delta}$ mode with four curved arms. In addition, four parasitic strips are introduced to the feed to increase the bandwidth. All of them are printed on one single substrate, which is better than $TE_{011+\delta}$-mode designs that require two feeding substrates. Also, the disclosed antenna structure is much simpler than designs that employ mechanisms to cut a cylindrical DRA into two parts. Further, the bandwidth of the disclosed design is over 18%, which is much wider than 4.5%-7.4% as found in the other $TE_{01\delta}$-and $TE_{011+\delta}$-m ode designs.

Based on the disclosed $TE_{011+\delta}$-mode design, a polarization-reconfigurable omnidirectional DRA is obtained by using a switching circuit with diodes. By controlling the states of the diodes, the polarization of the antenna can be switched from horizontal ($TE_{011+\delta}$ mode) to vertical ($TM_{01\delta}$ mode), and vice versa. To verify this mechanism, both the $TE_{011+\delta}$-mode and polarization-reconfigurable DRAs were fabricated and measured. Reasonable agreement between the measured and simulated results is obtained.

FIG. 1 shows a perspective view of an example of omnidirectional DRA 100. Specifically, omnidirectional DRA 100 is configured as a basic omnidirectional $TE_{011+\delta}$-mode DRA. The omnidirectional DRA 100 is a cylindrical DRA 103 with a radius of $R_d$, a height of $H_d$, and a dielectric constant of $\varepsilon_{rd}$ is placed on a circular substrate 101. The circular substrate 101 has a radius of $R_g$, a thickness of t, and a dielectric constant of $\varepsilon_{rs}$. Beneath the DRA 103 is a planar feed with four end-shorted arms 107 and coupled strips 109. The antenna is fed by a coaxial cable at the center 111 of the ground 105.

Figure 2:
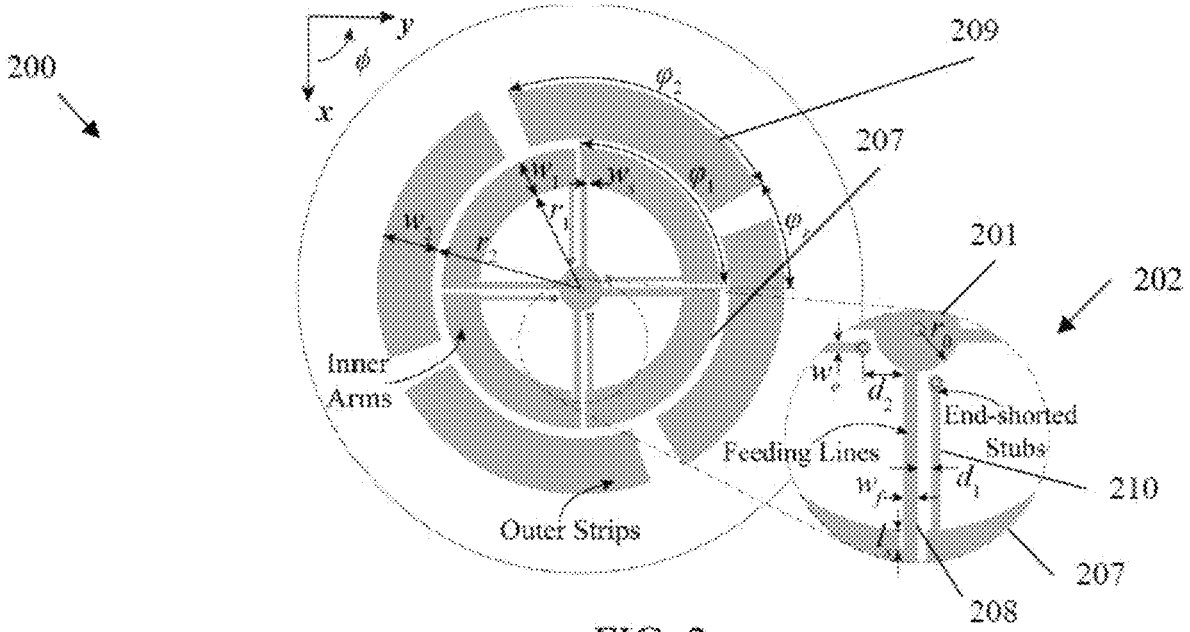
FIG. 2 shows a top view of an example planar feed of the omnidirectional DRA with a feeding structure including a zoomed in view of the planar feed.

FIG. 2 shows a top view of an example planar feed of the omnidirectional DRA 200 with a feeding structure including a zoomed in view 202 of the planar feed. FIG. 2 shows the parameters of the planar feed. With reference to the zoom-in view 202 of the planar feed, the small circular patch 201 at the center has a radius of $r_0$. The small circular patch 201 is connected to four curved inner arms 207 by four printed lines 208 having a width of $w_f$. The curved inner arms 207 have a radius of $r_1$, a width of $w_1$, and an angle of (pi. Each curved inner arm 207 has an end-shorted stub 210 with a width of we. The end-shorted stubs 210 are parallel to the printed lines 208 extended from the central circular patch 201, with a separation of $d_1$ between them. The currents of the end-shorted stubs 210 and printed lines 208 are out-of-phase, suppressing the cross-polar ($TM_{01\delta}$-mode) fields radiated by the printed lines 208. Four outer coupled strips 209 are introduced to improve the impedance matching and bandwidth. The outer coupled strips 209 have a radius of $r_2$, a width of $w_2$, and an angle of $\varphi_2$. The rotation angle between the inner arms 207 and outer strips 209 is $\varphi_r$.

In an example, the omnidirectional DRA 100 and/or 200 may be implemented with the following parameters: $R_d$=30.5 millimeters (mm), $H_d$=23 mm, t=1.524 mm, $\varepsilon_{rd}$=6.85, $\varepsilon_{rs}$=3.38, $R_g$=33 mm, $r_0$=1.85 mm, $r_1$=12 mm, $r_2$=17.4 mm, $r_s$=0.1 mm, $I_s$=1.9 mm, $\varphi_1$=86°, $\varphi_2$=68°, $\varphi_r$=42°, $w_1$=5 mm, $w_2$=6.5 mm, $w_e$=0.21 mm, $w_f$=0.3 mm, $w_s$=0.24 mm, $d_1$=1.2 mm, and $d_2$=4.2 mm.

Figure 3:
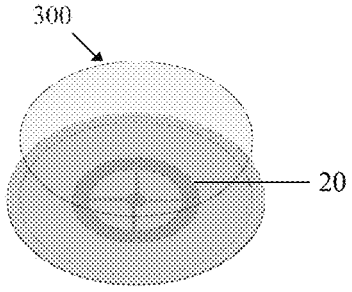
FIG. 3 shows an example configuration of a first reference antenna (Antenna I)
Figure 4:
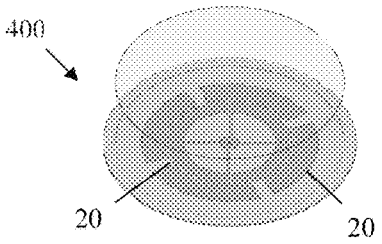
FIG. 4 shows an example configuration of a second reference antenna (Antenna II)
Figure 5:
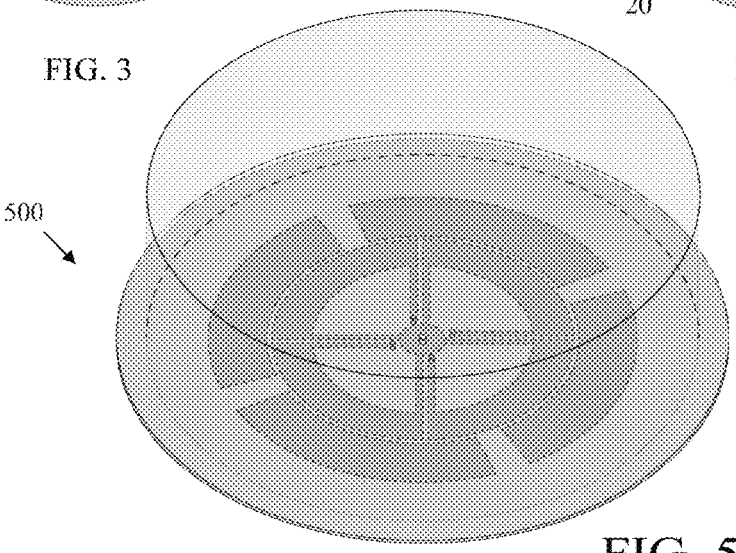
FIG. 5 shows an example configuration of the omnidirectional DRA.

An operating mechanism and parametric study is now discussed. Specifically, two reference antennas were simulated to study the operating mechanism of the omnidirectional DRA. FIG. 3 shows an example configuration of Antenna I 300. FIG. 4 shows an example configuration of Antenna II 400. FIG. 5 shows an example configuration of the omnidirectional DRA 500, which may be substantially similar to omnidirectional DRA 100 and/or 200. As shown in FIG. 3, Antenna I 300 only has the curved inner arms 207 without the coupled strips 209 or the end-shorted stubs 210. Antenna I 300 may be implemented with the following parameters: $r_1$=12.5 mm, $I_s$=0.1 mm. As shown in FIG. 4, Antenna II 400 has both the outer coupled strips 209 and the inner arms 207, with no end-shorted stubs 210. Antenna II 400 may be implemented with the following parameters: $r_1$=11.5 mm, $w_1$=4.5 mm. Other parameter values are as indicated for the omnidirectional DRA 100 and/or 200.

Figure 6:
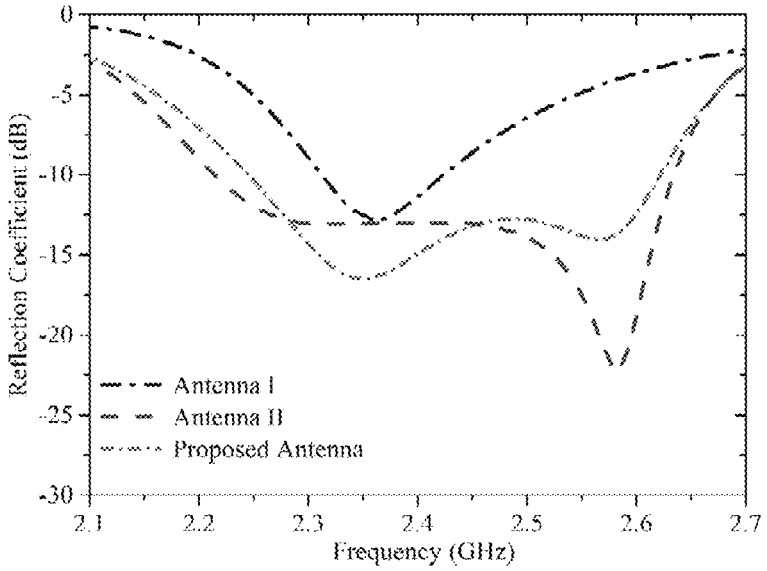
FIG. 6 shows a graph of an example of simulated reflection coefficients of the reference Antenna I, Antenna II, and the omnidirectional DRA.
Figure 7:
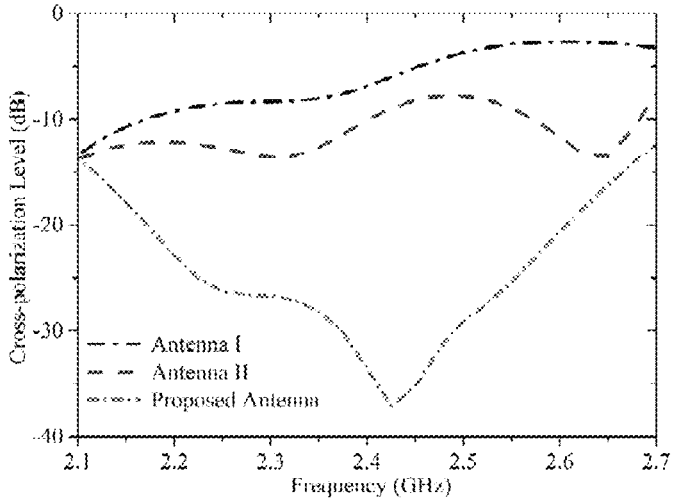
FIG. 7 shows a graph of an example of simulated cross-polarization levels of the reference Antenna I, Antenna II, and the omnidirectional DRA.

FIG. 6 shows a graph 600 of an example of simulated reflection coefficients of the reference Antenna I 300, Antenna II 400, and the omnidirectional DRA 500. FIG. 7 shows a graph 700 of an example of simulated cross-polarization levels of the reference Antenna I 300, Antenna II 400, and the omnidirectional DRA 500, for example at θ=60° and ϕ=90°. Specifically, the graphs 600 and 700 show the simulated reflection coefficients in decibels (dB) and cross-polarization level in dB of the reference and omnidirectional DRA antennas versus frequency in gigahertz (GHz). With reference to the FIG. 6, Antenna I has only one resonant mode at 2.35 GHz with a very limited impedance bandwidth (e.g., 3%). This is in accord with the intrinsic narrow impedance bandwidth of the $TE_{011+\delta}$ mode. For Antenna II and the omnidirectional DRA, however, the impedance bandwidths are greatly improved by having an additional resonant mode at ~2.6 GHz due to the coupled outer strips. With the additional resonant mode, the bandwidths of Antennas II and the omnidirectional DRA are 16.9% and 15.6%, respectively. The cross-polarization levels of the three antennas are shown in FIG. 7. As shown in graph 700, Antenna I has a cross-polarization level of higher than −8 dB. For Antenna II, the cross-polarization level is still higher than −14 dB. In contrast, the omnidirectional DRA has the lowest cross-polarization level because of the four end-shorted stubs. For example, at 2.4 GHz, the cross-polarization level of the omnidirectional DRA is lower than that of Antenna II by more than 25 dB. From 2.2 GHz to 2.6 GHz, the cross-polarization of the omnidirectional DRA is quite stable, being lower than −20 dB.

Figure 8:
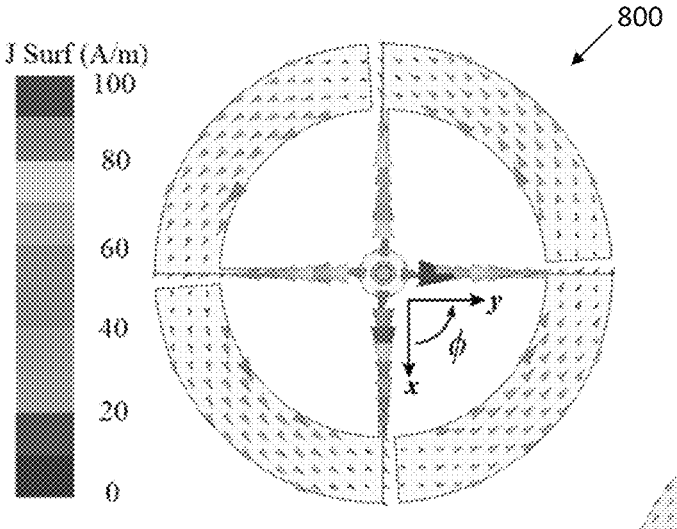
FIG. 8 shows an example of simulated surface current distribution of planar feeds of Antenna I.
Figure 9:
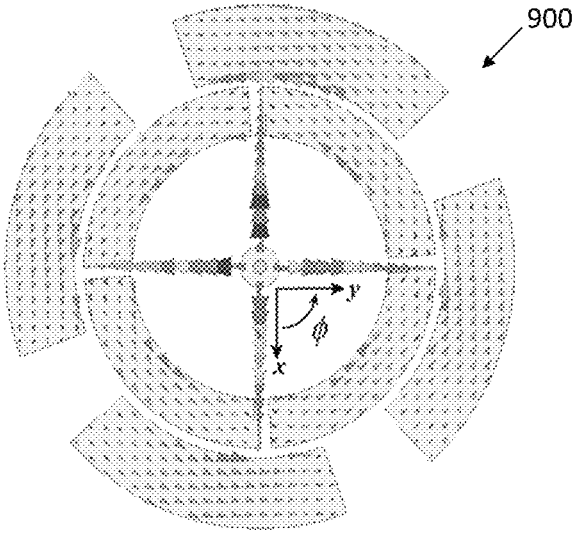
FIG. 9 shows an example of simulated surface current distribution of planar feeds of Antenna II.
Figure 10:
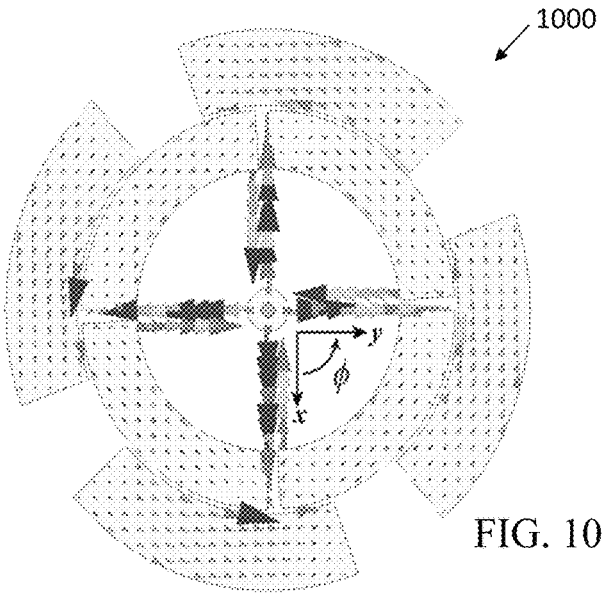
FIG. 10 shows an example of simulated surface current distribution of planar feeds of the omnidirectional DRA.

FIG. 8 shows an example of simulated surface current distribution 800 of planar feeds of Antenna I. FIG. 9 shows an example of simulated surface current distribution 900 of planar feeds of Antenna II. FIG. 10 shows an example of simulated surface current distribution 1000 of planar feeds of the omnidirectional DRA. As such, the simulated surface currents on the planar feeds of the three antennas are shown in FIGS. 8-10, for example at 2.35 GHz. With reference to FIGS. 8-10, the surface currents on the four curved inner arms mainly flow along the φ direction. They excite the $TE_{011+\delta}$ mode of the cylindrical DRA, giving $E_\varphi$ (co-polarization) in the far field. However, FIG. 8 shows that strong currents are found on the cross-shaped printed lines. The radial currents contribute to $E_\theta$ (cross-polarization) in the far field. Therefore, the cross-polarization level in Antenna I is very high, as confirmed in FIG. 7. Similar phenomena are observed in Antenna II, as shown in FIG. 9. In FIG. 10, the out-of-phase currents are introduced by the end-shorted stubs. They cancel out the radiation of the radial currents on the cross-shaped printed lines, greatly reducing the cross-polar field of the omnidirectional DRA.

Figure 11:
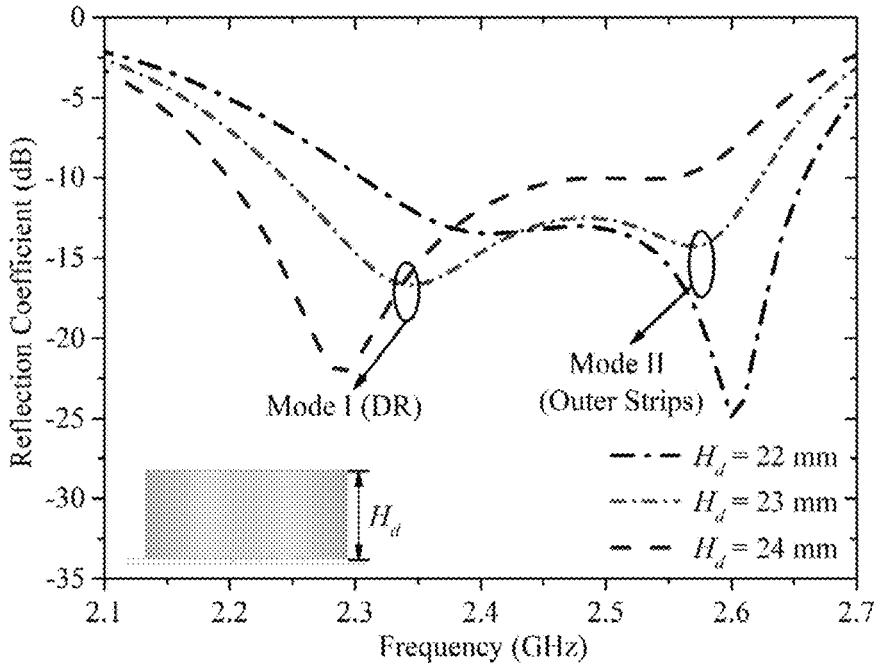
FIG. 11 shows an example parametric study of reflection coefficients of the omnidirectional DRA as effected by dielectric resonator (DR) height.
Figure 12:
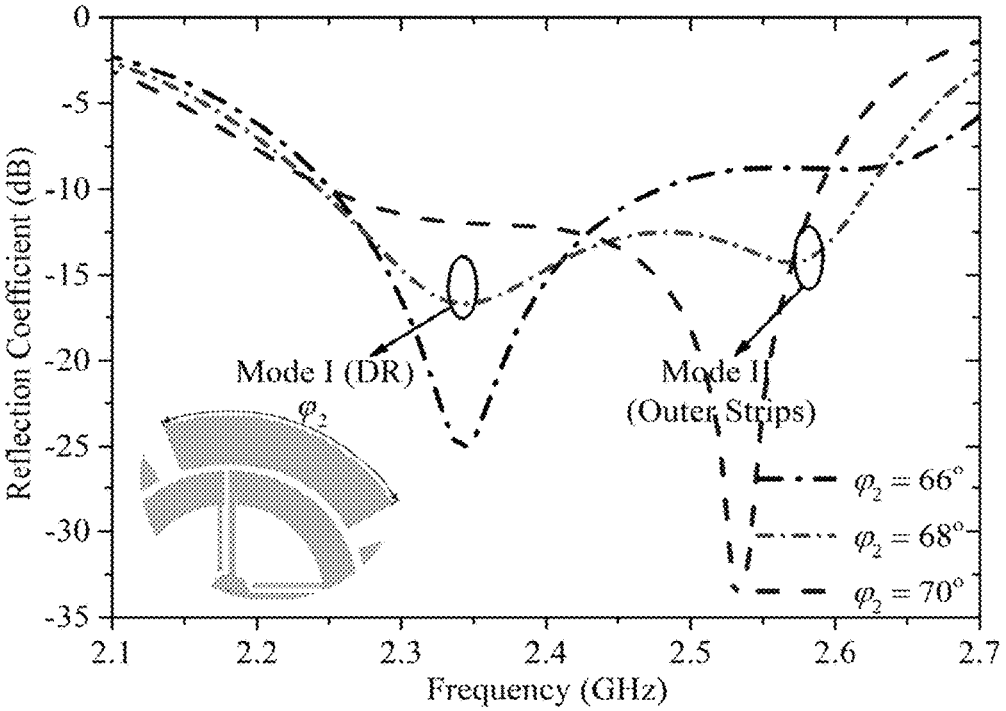
FIG. 12 shows an example parametric study of reflection coefficients of the omnidirectional DRA as effected by an outer strip angle.

A parametric study was conducted to verify the operating modes of the omnidirectional DRA. FIG. 11 shows an example parametric study 1100 of reflection coefficients, in dBs versus frequency in GHz, of the omnidirectional DRA as effected by DR height, $H_d$. FIG. 12 shows an example parametric study 1200 of reflection coefficients, in dBs versus frequency in GHz, of the omnidirectional DRA as effected by an outer strip angle, $\varphi_2$. As such, FIGS. 11-12 show the simulated reflection coefficient for different parameter values of the DRA and outer strips. With reference to FIG. 11, the operating frequency of Mode I decreases significantly as the $H_d$ increases, whereas the frequency of Mode II shifts only slightly. This verifies that Mode I is a DRA mode. Since the coupling with the outer stripes is influenced by the DRA, the DRA height $H_d$ affects the matching level of Mode II. A similar result was observed when the DRA radius ($R_d$) was changed. The result, however, is not included here for brevity. FIG. 12 shows the reflection coefficient for different outer strip angles. As shown in the FIG. 12, the operating frequency of Mode II is affected by $\varphi_2$, with almost no effects on the operating frequency of Mode I. This verifies that Mode II is due to the outer strips. A similar phenomenon was also observed when the strip width ($w_2$) was changed.

Figure 13A:
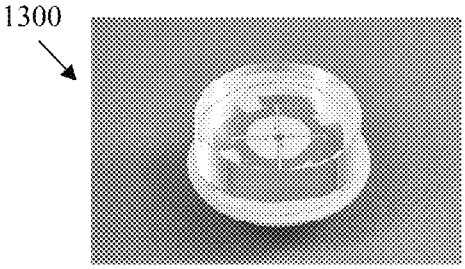
FIG. 13A shows a perspective view of an example of a fabricated omnidirectional DRA.
Figure 13B:
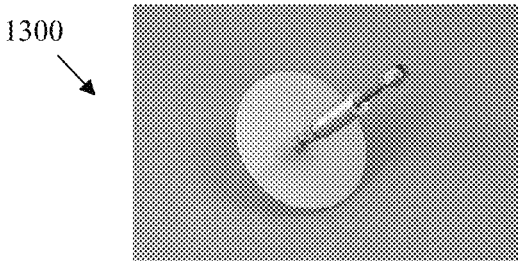
FIG. 13B shows a bottom view of the example fabricated omnidirectional DRA with a coaxial cable and an radio frequency (RF) choke.

Measured and simulated results are now discussed. FIG. 13A shows a perspective view of an example of a fabricated omnidirectional DRA 1300. FIG. 13B shows a bottom view of the example fabricated omnidirectional DRA 1300 with a coaxial cable and an RF choke. FIGS. 13A-13B show a prototype of the omnidirectional DRA 1300, with parameter values as described in FIGS. 1-2. The cylindrical DRA 1300 is made of K9 glass with a dielectric constant of εrd=6.85. In the example, the reflection coefficient, the realized gain, the radiation pattern, and the efficiency of the antenna were measured. An RF choke was used to suppress undesired return current on the outer conductor of the coaxial cable.

Figure 14:
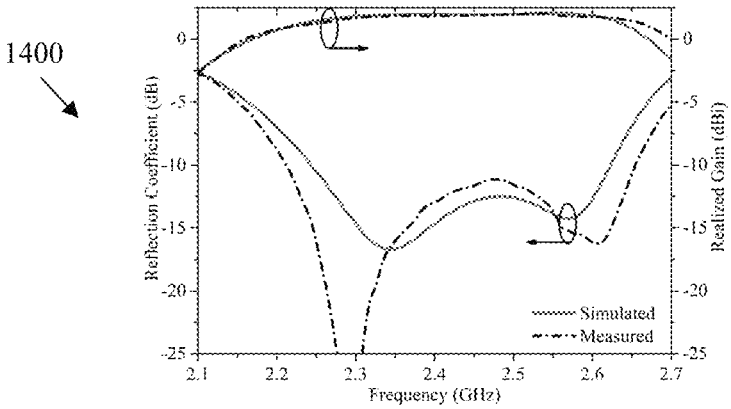
FIG. 14 shows an example graph of measured and simulated reflection coefficients and realized gains of the omnidirectional DRA.

FIG. 14 shows an example graph 1400 of measured and simulated reflection coefficients, in dBs versus frequency in GHz, and realized gains of the omnidirectional DRA. With reference to graph 1400, the measured results are in reasonable agreement with the simulated results. Two dips in the reflection coefficient are observed at around 2.3 GHz and 2.6 GHz due to the DRA and outer strips, respectively. The measured −10-dB impedance bandwidth is about 18.1% (2.21-2.65 GHz). In the impedance passband, the measured gain ranges from 0.98 dBi to 2.04 dBi, with an average value of 1.7 dBi.

Figure 15:
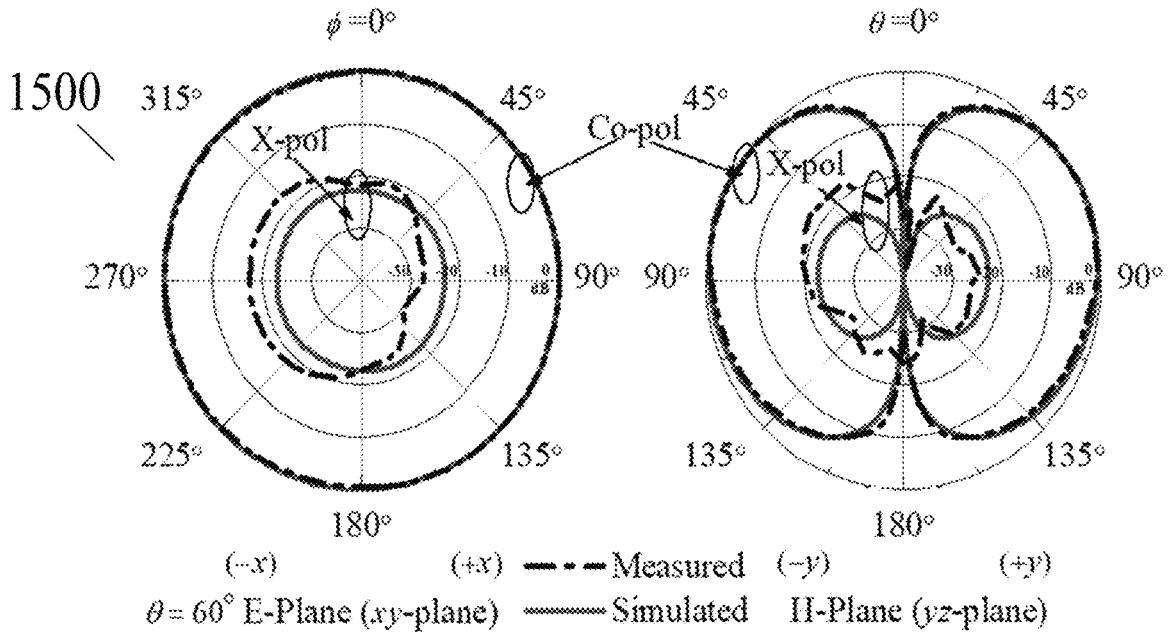
FIG. 15 shows an example of normalized measured and simulated radiation patterns of the omnidirectional DRA at 2.21 gigahertz (GHz)
Figure 16:
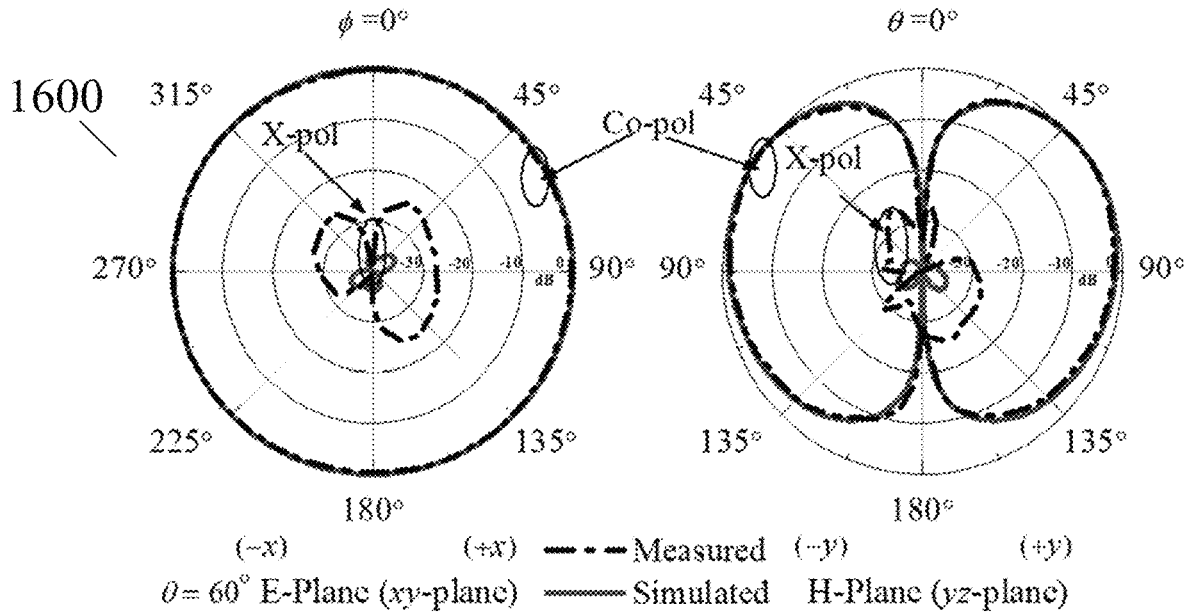
FIG. 16 shows an example of normalized measured and simulated radiation patterns of the omnidirectional DRA at 2.43 GHz.
Figure 17:
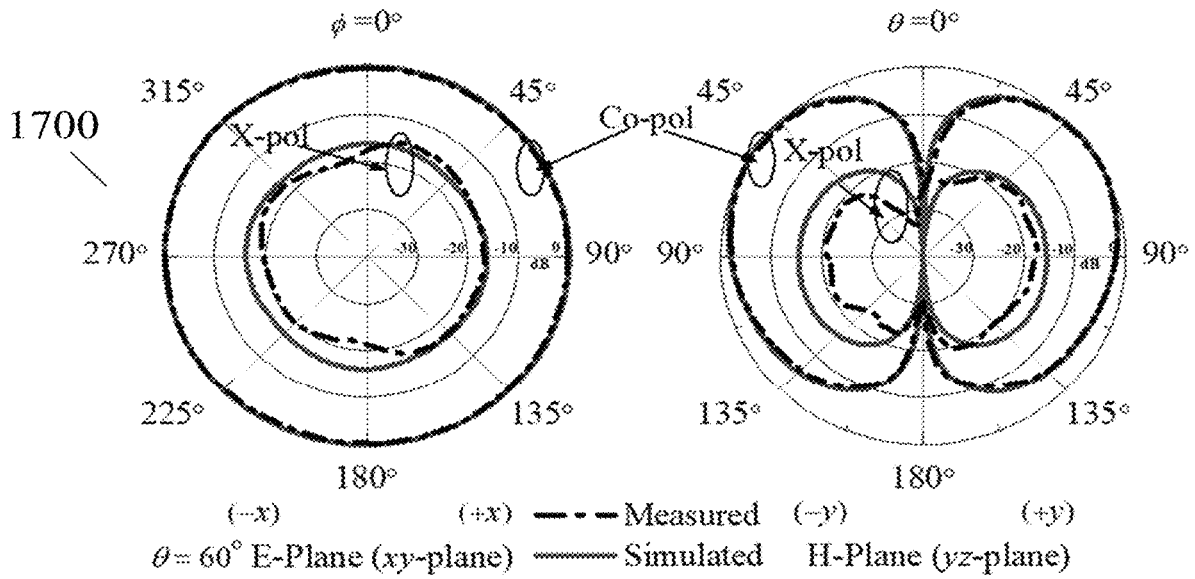
FIG. 17 shows an example of normalized measured and simulated radiation patterns of the omnidirectional DRA at 2.65 GHz.
Figure 18:
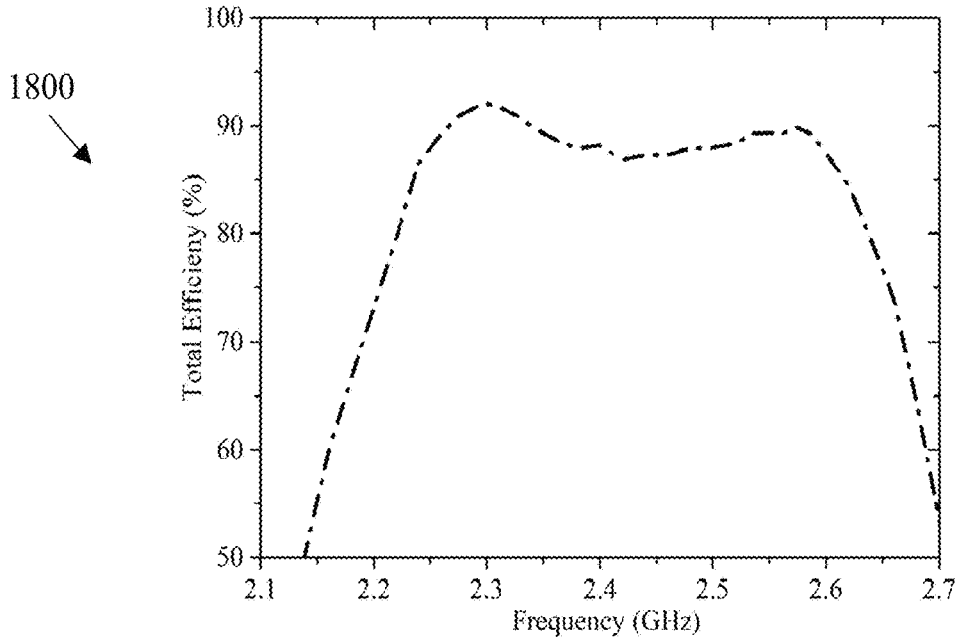
FIG. 18 shows an example of the measured total antenna efficiency of the omnidirectional DRA with included mismatch.

FIG. 15 shows an example of normalized measured and simulated radiation patterns 1500 of the omnidirectional DRA at 2.21 GHz. FIG. 16 shows an example of normalized measured and simulated radiation patterns 1600 of the omnidirectional DRA at 2.43 GHz. FIG. 17 shows an example of normalized measured and simulated radiation patterns 1700 of the omnidirectional DRA at 2.65 GHz. The measurements agree well with the simulations, with the discrepancy caused by fabrication errors and experimental tolerances. As can be observed from FIGS. 15-17, the omnidirectional DRA has omnidirectional and symmetrical radiation patterns, as expected. The measured co-polar fields are stronger than the cross-polar counterparts by more than 15 dB. FIG. 18 shows an example of the measured total antenna efficiency 1800 of the omnidirectional DRA, versus frequency in GHz, with included mismatch. With reference to FIG. 18, the omnidirectional DRA has an average total efficiency of 87.2%, with a peak value of 92.1% at 2.3 GHz.

TABLE I

COMPARISON BETWEEN PROPOSED AND REPORTED DRAS

| Ref. | Feed Layer | Modes | −10-dB Impedance Bandwidth | Solid DR | Gain Variation in E-plane/dB | Size/$\lambda_0^3$ |
|---|---|---|---|---|---|---|
| [8] | 2 | $TE_{011+\delta}$ | 7.4% | N | N.A. | 1.3 × 1.3 × 0.24 |
| [9] | 1 | $TE_{01\delta}$ | 4.5% | N | 0.5 | 0.33 × 0.33 × 0.1 |
| [10] | 1 | $TE_{01\delta}$ | 7% | Y | >5 | N.A. |
| This Work | 1 | $TE_{011+\delta}$ | 18.1% | Y | 0.5 | 0.53 × 0.53 × 0.21 |

$\lambda_0$: free-space wavelength at center frequency of impedance passband.
$\lambda_0$: free-space wavelength at center frequency of impedance passband.

Table I compares the omnidirectional DRA with other example antennas. As can be observed from Table I, the disclosed omnidirectional DRA has the widest −10-dB impedance bandwidth among the various designs.

Figure 19:
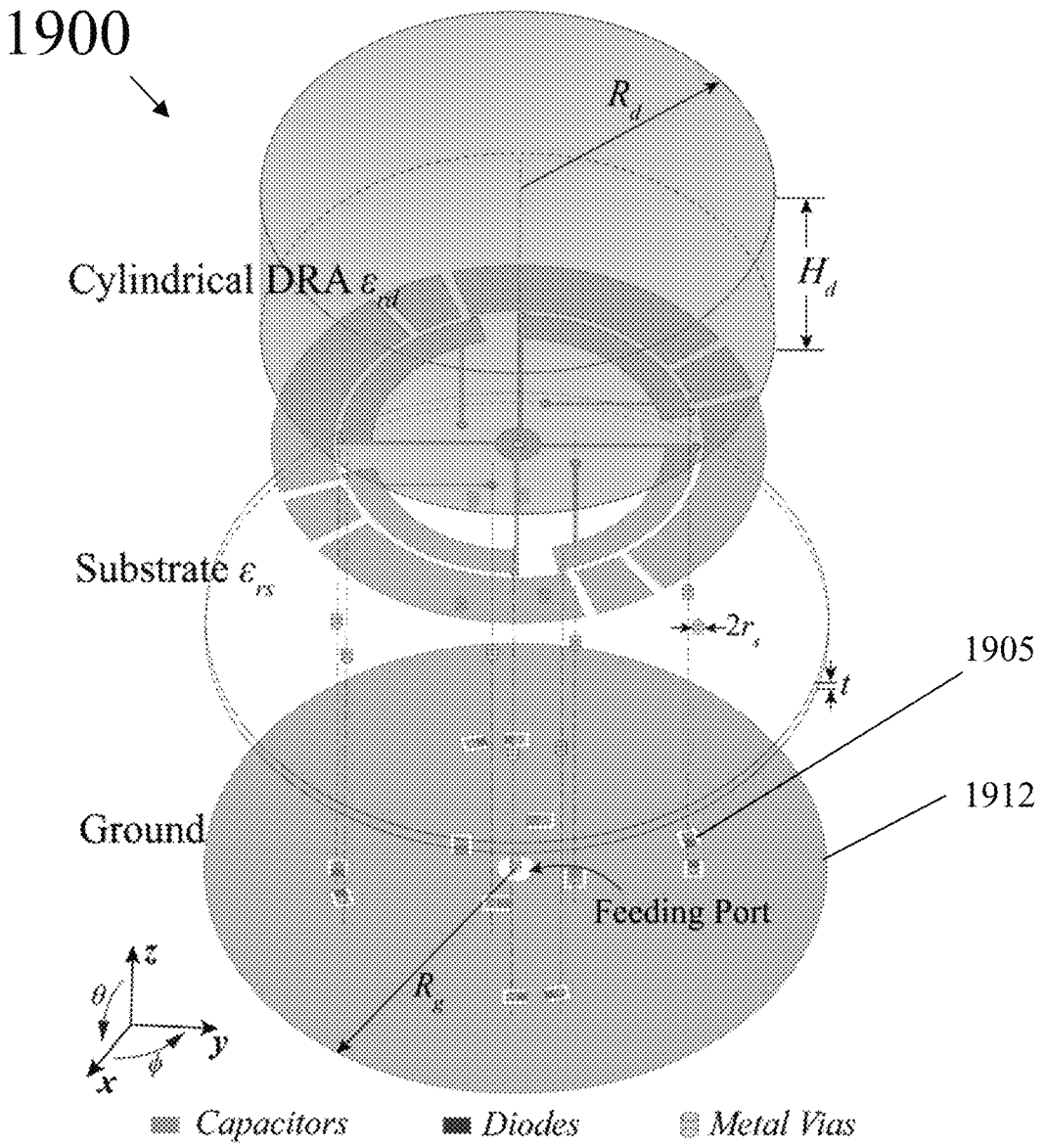
FIG. 19 shows a perspective view of an example configuration of a polarization-reconfigurable omnidirectional DRA.
Figure 20:
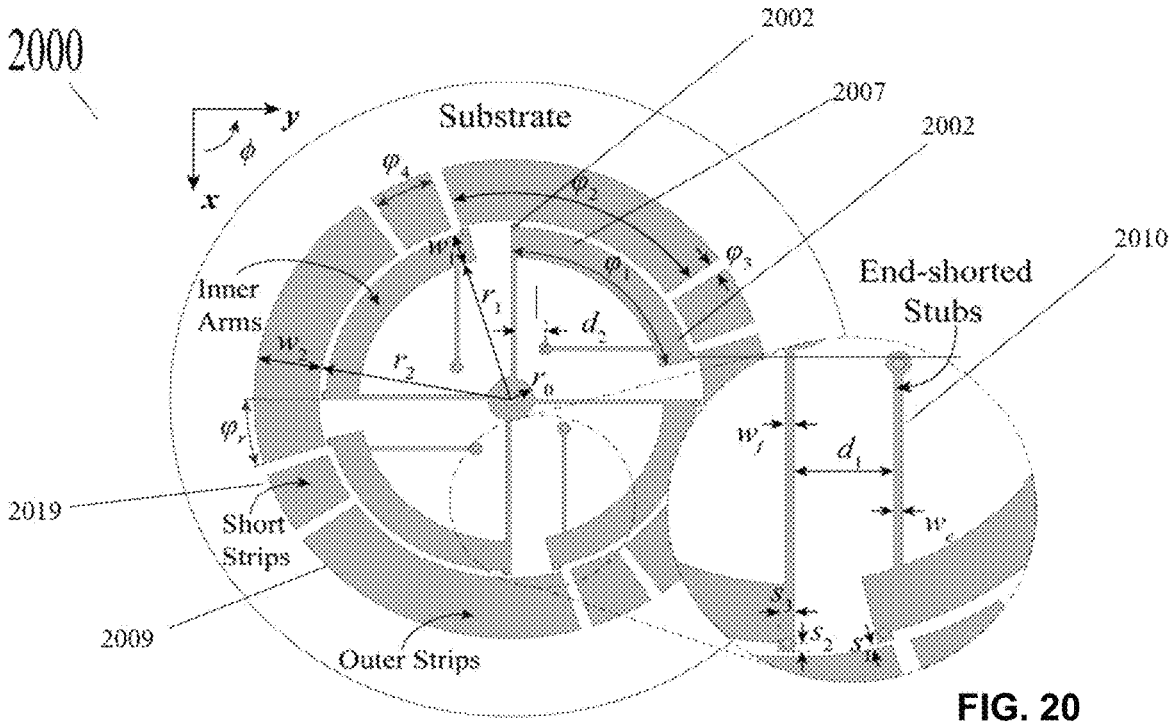
FIG. 20 shows a top zoomed in view of an example planar feed the polarization-reconfigurable omnidirectional DRA.
Figure 21:
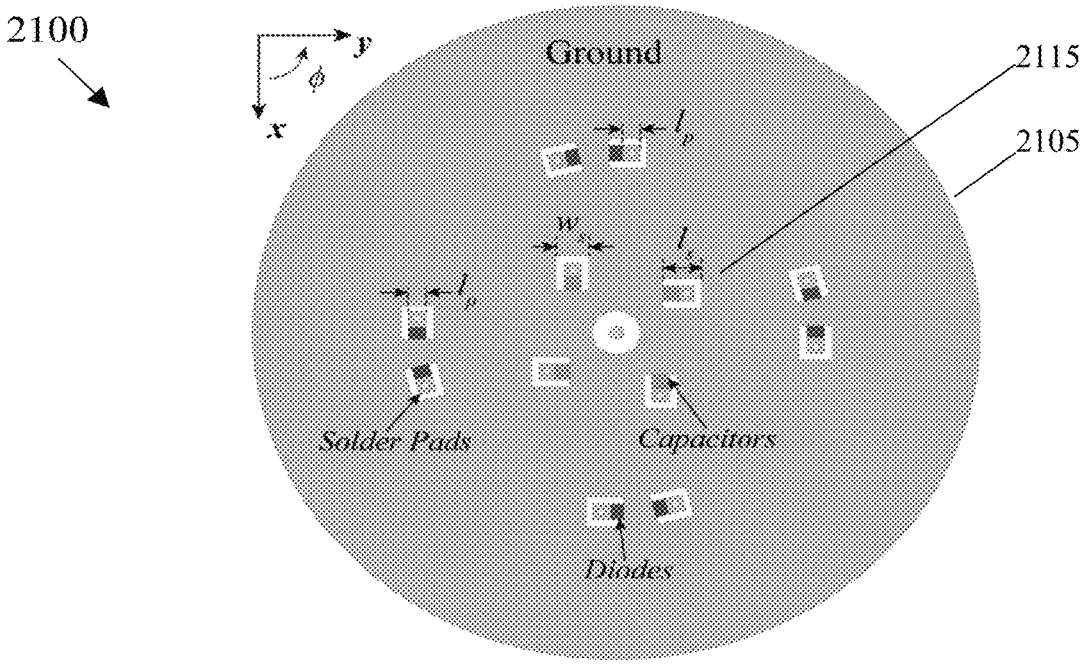
FIG. 21 shows a bottom view of the example configuration of the polarization-reconfigurable omnidirectional DRA including the other side of the substrate shown in FIGS. 19-20.

A polarization-reconfigurable DRA is now discussed. Specifically, a polarization-reconfigurable omnidirectional DRA is described using the $TE_{011+\delta}$-mode DRA. FIG. 19 shows a perspective view of an example configuration of a polarization-reconfigurable omnidirectional DRA 1900. FIG. 20 shows a top zoomed in view of an example planar feed of the polarization-reconfigurable omnidirectional DRA 2000. FIG. 21 shows a bottom view of the example configuration of the polarization-reconfigurable omnidirectional DRA 2100 including the other side of the substrate shown in FIGS. 19-20.

Accordingly, FIGS. 19-21 show a configuration of a polarization-reconfigurable DRA. As can be observed from FIGS. 19-20, each curved inner arm 2007 has two metal vias 2002. The two metal vias 2002 are used to connect the inner arm 2007 to two PIN diodes 1912 soldered on the ground plane 1905 for the polarization switching. Since there are four inner arms 2007, the polarization-reconfigurable DRA has eight metal vias 2002 and eight PIN diodes 1912 in total. FIG. 21 shows that four additional short strips 2019 with a width of $w_2$ and an angle of $\varphi_4$ are etched between the outer strips 2009. The short strips 2019 are used to improve the symmetry of the out-of-phase currents on each inner strip 2009, which lowers the cross-polar level in the $TM_{01\delta}$ state. With reference to FIGS. 20 and 21, four 9-pF capacitors 2115 are connected to the end-shorted stubs 2010 to block the DC currents. Like the diodes 1912, the capacitors 2115 are placed on the ground plane side 2105 to avoid mutual interferences between them and the DR, as shown in FIG. 21. In an example implementation, NXP BAP55LX pin-diodes are used as switches with DC biasing voltages provided by a Mini-Circuits ZX85-40 W-63-S+ bias tee.

In an example implementation, the polarization-reconfigurable omnidirectional DRA 1900, 2000, and/or 2100 employs the following parameters: $R_d$=29 mm, $H_d$=25 mm, t=1.524 mm, $\varepsilon_{rd}$=6.85, $\varepsilon_{rs}$=3.38, $R_g$=34 mm, $r_0$=1.5 mm, $r_1$=14.8 mm, $r_2$=17.0 mm, $r_s$=0.15 mm, $I_s$=1.4 mm, $I_p$=0.7 mm, $s_1$=0.1 mm, $s_2$=1.2 mm, $s_3$=0.6 mm, $\varphi_1$=77.0°, $\varphi_2$=67.5°, $\varphi_3$=0.5°, $\varphi_4$=21.5°, $\varphi_r$=15.0°, $w_1$=1.6 mm, $w_2$=7.0 mm, $w_e$=0.2 mm, $w_f$=0.25 mm, $w_s$=1.1 mm, $d_1$=5.83 mm, and $d_2$=4.45 mm.

Polarization reconfigurability is now described. The polarization reconfigurability of the antenna can be realized by turning the diodes 1912 on or off through biasing voltages. When the diodes 1912 are in the off state, the inner arms 2007 are open and the $TE_{011+\delta}$ mode of the antenna is excited. When the diodes 1912 are in the on state, the inner arms 2007 are shorted to the ground 1905, which excites the $TM_{01\delta}$ mode of the DRA. In an example, Simulation Program With Integrated Circuit Emphasis (SPICE) models of the diodes for the two states can be utilized in high frequency structure simulator (HFSS) simulations.

Figure 22:
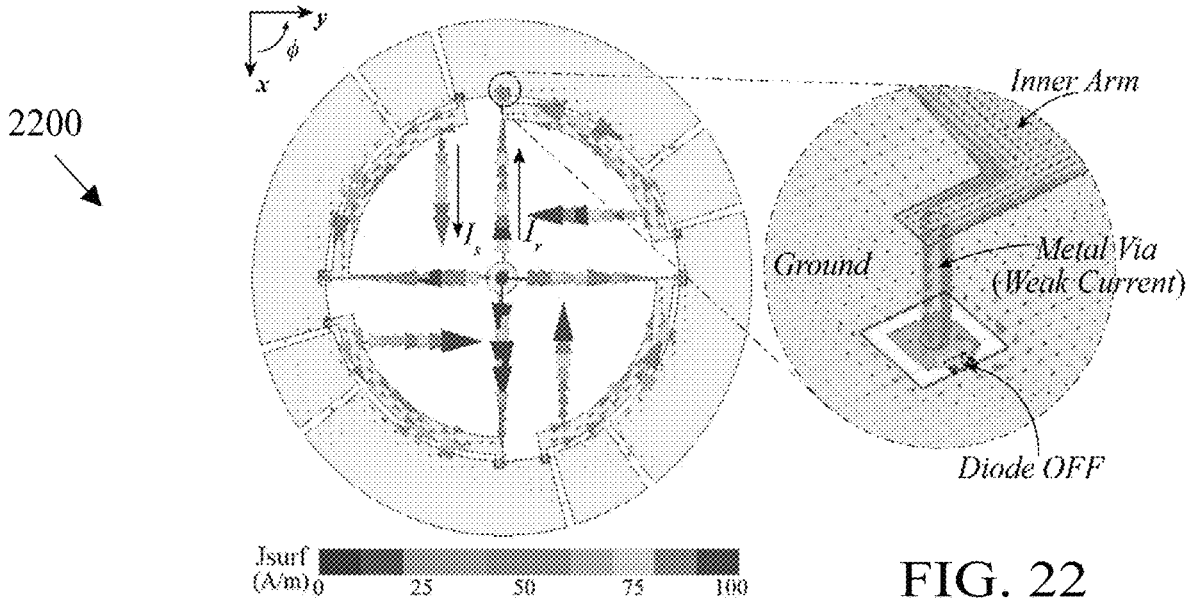
FIG. 22 shows an example of simulated surface current of the omnidirectional DRA at 2.4 GHz when the diodes are in the off state including surface current distribution on a planar feed along with a zoomed in view of diode current.
Figure 23:
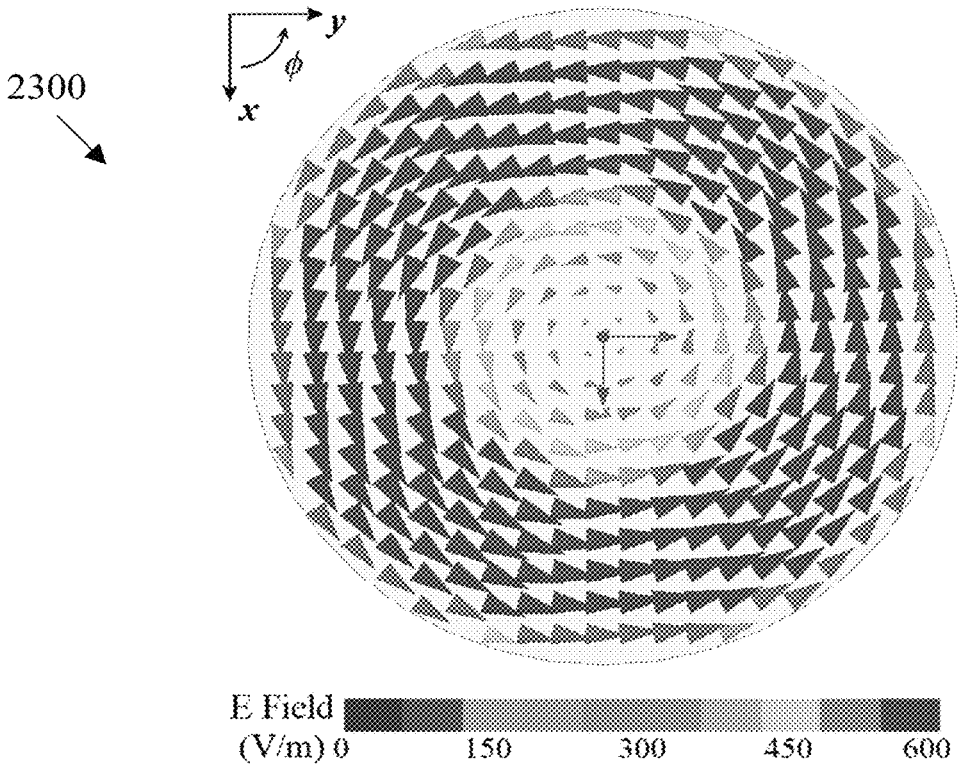
FIG. 23 shows an example of field distributions of the omnidirectional DRA at 2.4 GHz when the diodes are in the off state including electric field (E-field) distribution of the cylindrical DRA.

FIG. 22 shows an example of simulated surface current 2200 of the omnidirectional DRA at 2.4 GHz when the diodes are in the off state including surface current distribution on a planar feed along with a zoomed in view of diode current. FIG. 23 shows an example of field distributions 2300 of the omnidirectional DRA at 2.4 GHz when the diodes are in the off state including E-field distribution of the cylindrical DRA. FIG. 23 depicts an xy-plane, where $z=H_d/2$=12.5 mm. Accordingly, FIGS. 22-23 show the simulated current 2200 and field distributions 2300 of the $TE_{011+\delta}$ mode when the diodes are off. In this state, the diodes have a high impedance, and the currents flowing from the diodes to the ground are very weak, as shown in the zoom-in view of FIG. 22. FIG. 22 shows that the surface current 2200 on the planar feed are similar to that of the basic design in FIG. 10. As can be observed from FIG. 22, the radial current $I_r$ on the cross-shaped printed lines and the current $I_s$ on the end-shorted stub are out of phase. Therefore, their radiation fields cancel out each other, and therefore the cross-polar field (Ee) in the far field is weak. With reference to FIG. 22, the azimuthal currents on the inner arms are in phase. These currents strongly excite the $TE_{011+\delta}$ mode of the DRA, contributing to the co-polar $E_\varphi$ in far field. FIG. 23 shows the E-field distribution of the DRA in the xy-plane at z=12.5 mm (e.g., at the middle of the DRA). In FIG. 23, an example E-field distribution of the $TE_{011+\delta}$ mode can be observed.

Figure 24:
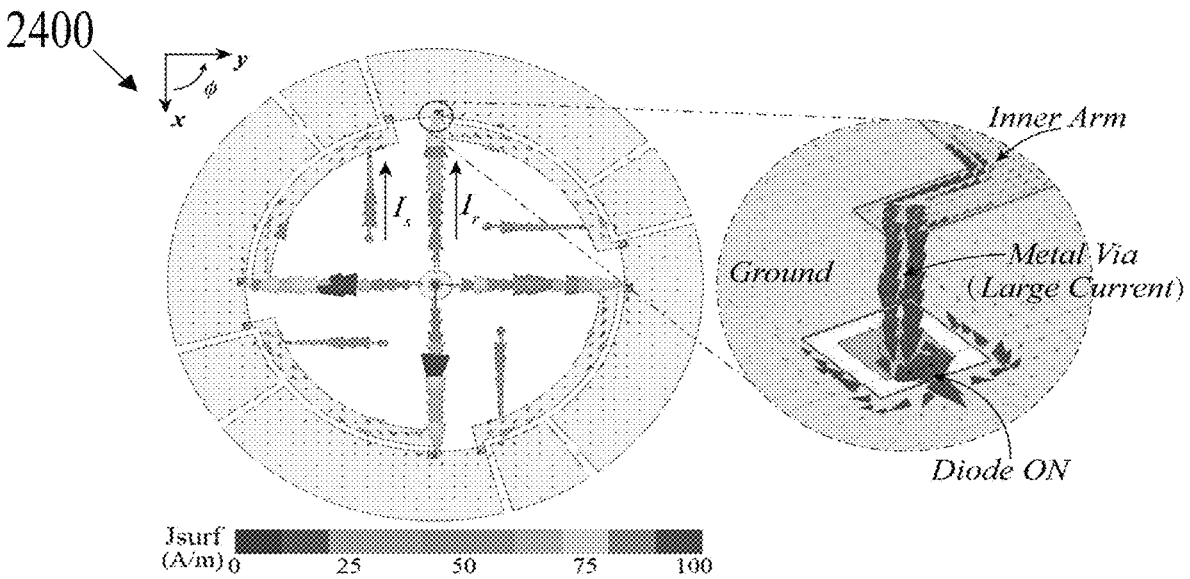
FIG. 24 shows an example of simulated surface current of the omnidirectional DRA at 2.4 GHz when the diodes are in the on state including surface current distribution on a planar feed along with a zoomed in view of diode current.
Figure 25:
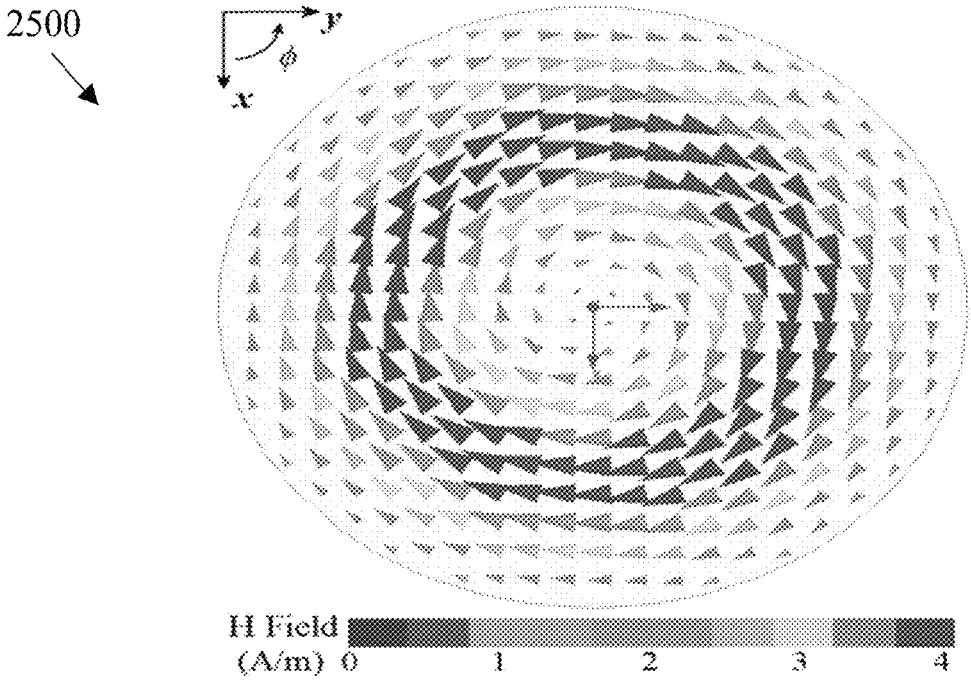
FIG. 25 shows an example of field distributions of the omnidirectional DRA at 2.4 GHz when the diodes are in the on state including magnetic field (H-field) distribution of the cylindrical DRA.

FIG. 24 shows an example of simulated surface current 2400 of the omnidirectional DRA at 2.4 GHz when the diodes are in the on state including surface current distribution on a planar feed along with a zoomed in view of diode current. FIG. 25 shows an example of field distributions 2500 of the omnidirectional DRA at 2.4 GHz when the diodes are in the on state including H-field distribution of the cylindrical DRA.

Accordingly, FIGS. 24-25 show the simulated current and field distributions of the omnidirectional DRA in the on state. Since the diodes have a low internal resistance in this case, large currents flow from the diodes to the ground, as shown in the zoom-in view of FIG. 24. Different from the off case, the radial current $I_r$ on the cross-shaped printed lines and the end-shorted-stub current $I_s$ are now in phase, as shown in FIG. 24. These currents excite the $TM_{01\delta}$ mode of the DRA, radiating the co-polar Ee in the far field. The azimuthal currents on the inner arms, which contributes to the cross-polar $E_\varphi$, are very weak in this case. Also, since the azimuthal currents on the inner arms are out-of-phase, their radiated fields cancel out each other in the far field. As a result, the cross-polar field can be reduced effectively. FIG. 25 shows the simulated H-field in the DRA at $z=H_d/2=12.5$ mm.

Figure 26A:
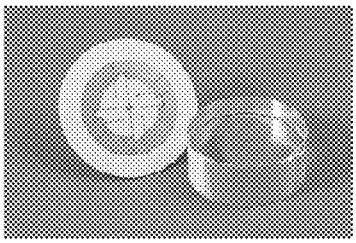
FIG. 26A shows a perspective view of an example of a fabricated omnidirectional DRA.
Figure 26B:
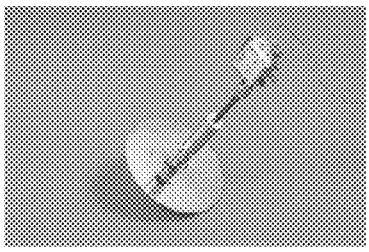
FIG. 26B shows a bottom view of the example fabricated omnidirectional DRA with a coaxial cable and an RF choke.

Measured and simulated results are now described. FIG. 26A shows a perspective view of an example of a fabricated omnidirectional DRA 2600. FIG. 26B shows a bottom view of the example fabricated omnidirectional DRA 2600 with a coaxial cable and an RF choke. An example of the polarization-reconfigurable omnidirectional DRA was fabricated and measured, with the parameter values described in FIG. 21. FIGS. 26A and 26B show the prototype. Again, a balun was used in the measurement to reduce the undesired return current on the outer conductor of the coaxial cable. A DC source was connected to the bias tee to supply the biasing voltages to the diodes.

Figure 27:
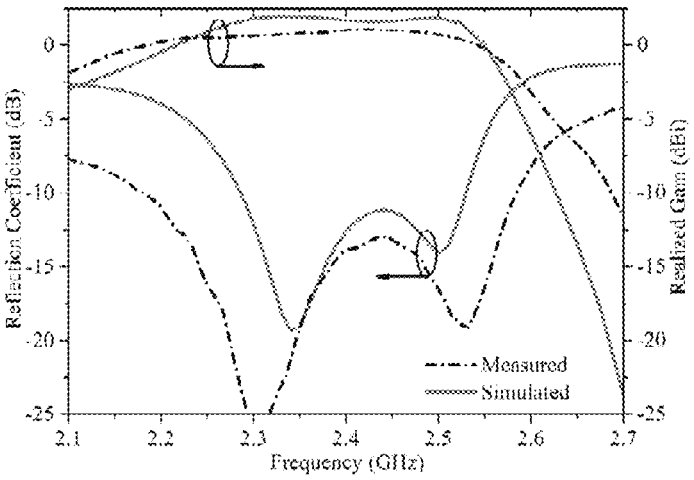
FIG. 27 shows an example of measured and simulated reflection coefficients and realized gains of a polarization-reconfigurable DRA in the off state.
Figure 28:
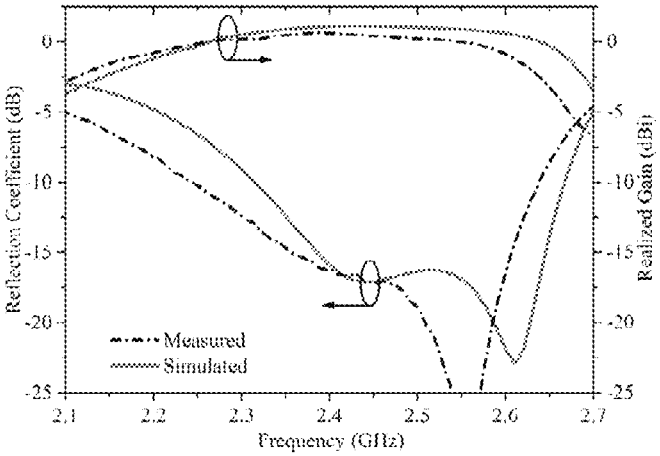
FIG. 28 shows an example of measured and simulated reflection coefficients and realized gains of a polarization-reconfigurable DRA in the on state.

FIG. 27 shows an example of measured and simulated reflection coefficients 2700, in dB versus frequency in GHz, and realized gains of a polarization-reconfigurable DRA in the off state. FIG. 28 shows an example of measured and simulated reflection coefficients 2800, in dB versus frequency in GHz, and realized gains of a polarization-reconfigurable DRA in the on state. As such, FIGS. 27-28 show the measured and simulated reflection coefficients and realized gains of the antenna in the off and on states, respectively. As can be observed from the FIGS. 27-28, the measured −10-dB impedance bandwidth in the off and on states are 16.8% (2.18-2.58 GHz) and 16.0% (2.25-2.64 GHz), respectively. Their overlapping impedance bandwidth is 13.7% (2.25-2.58 GHz). As shown in FIG. 27, in the off state, the $TE_{011+\delta}$-mode DRA has an average realized gain of 0.66 decibel relative to isotrope (dBi), with a maximum value of 1.1 dBi at 2.42 GHz. With reference to FIG. 28, when the diodes are in the on state, the $TM_{01\delta}$-mode antenna has an average realized gain of 0.3 dBi over the impedance passband. The peak gain is 0.62 dBi at 2.38 GHz. Due to experimental imperfections that include diode loss, the measured average realized gain is 0.6 dB lower than the simulated average gain.

Figure 29:
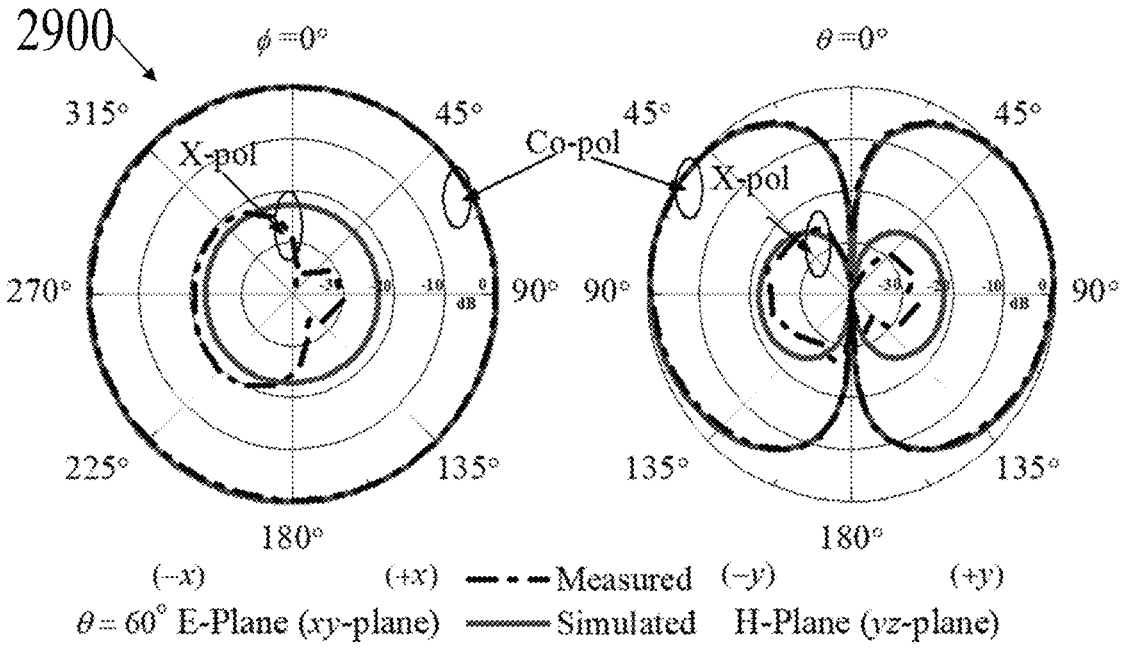
FIG. 29 shows an example of measured and simulated normalized radiation patterns of the polarization-reconfigurable omnidirectional DRA at 2.4 GHz in the off state.
Figure 30:
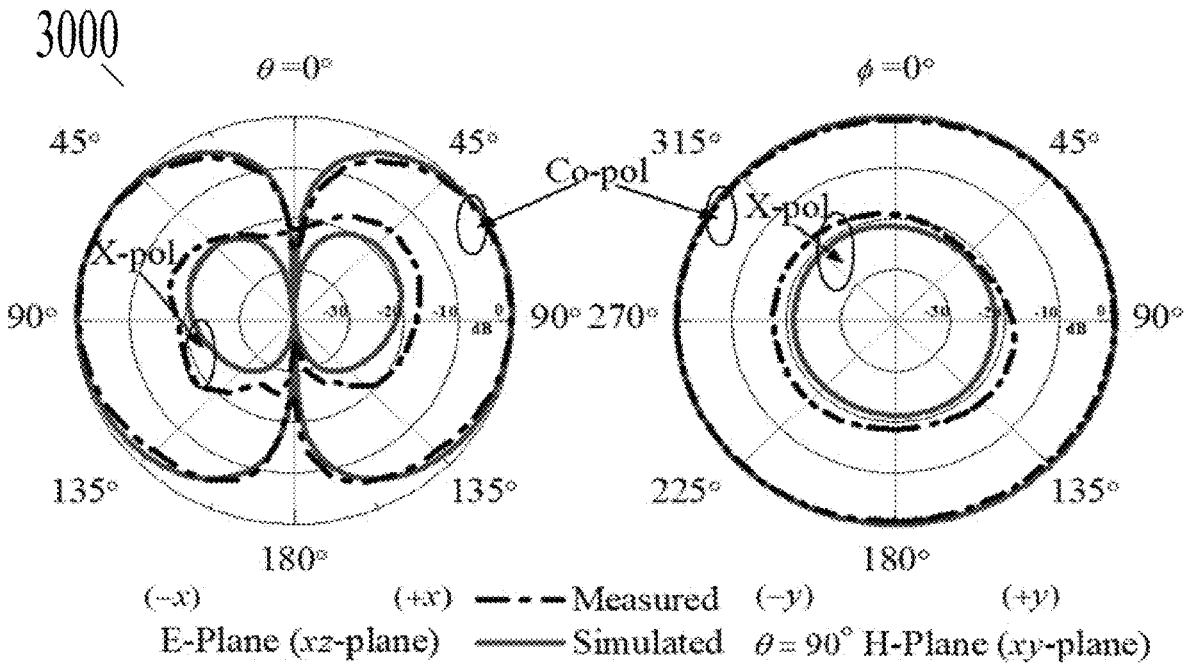
FIG. 30 shows an example of measured and simulated normalized radiation patterns of the polarization-reconfigurable omnidirectional DRA at 2.4 GHz in the on state.

FIG. 29 shows an example of measured and simulated normalized radiation patterns 2900 of the polarization-reconfigurable omnidirectional DRA at 2.4 GHz in the off state. FIG. 30 shows an example of measured and simulated normalized radiation patterns 3000 of the polarization-reconfigurable omnidirectional DRA at 2.4 GHz in the on state. Accordingly, FIGS. 29-30 show the measured and simulated normalized radiation patterns of the antenna in the off and on states at 2.4 GHz. As can be observed from FIGS. 29-30, the measured results are in agreement with the simulated results. In FIG. 29 (off state), the antenna has horizontally polarized omnidirectional radiation patterns. The measured cross-polar fields in both E and H planes are lower than the co-polar counterparts by more than 19 dB. In FIG. 30 (on state), the $TM_{01\delta}$-mode DRA has vertically polarized omnidirectional radiation patterns. Because of the parasitic effects of the diodes in the on state, the measured cross-polar field is stronger than the simulated result. Nevertheless, the cross-polar field is still weaker than its co-polar counterpart by at least 15 dB.

Figure 31:
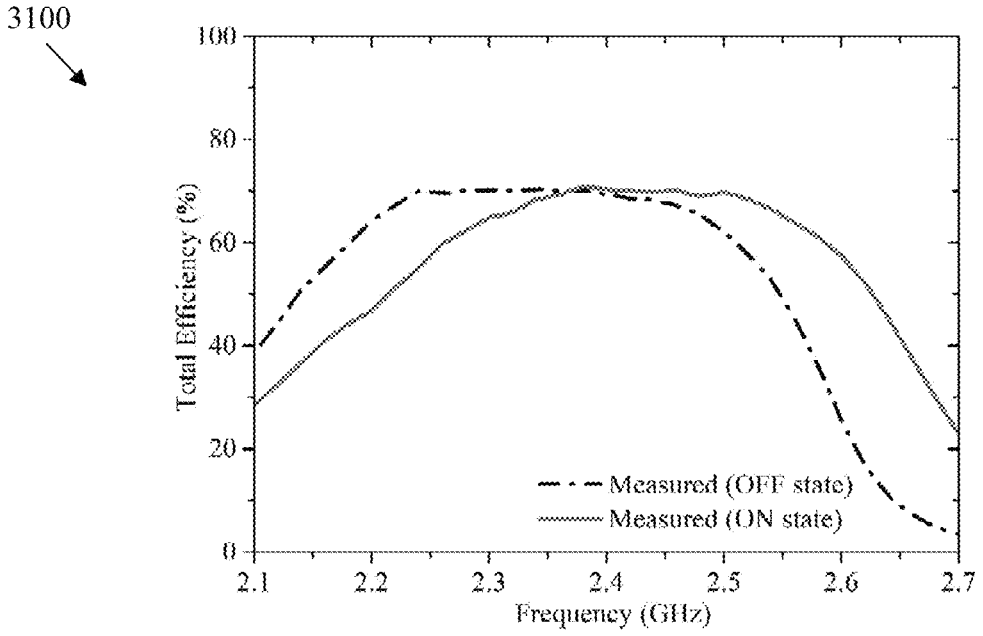
FIG. 31 shows an example of measured total antenna efficiency of a polarization-reconfigurable omnidirectional DRA in both off and on states.

FIG. 31 shows an example of measured total antenna efficiency 3100, versus frequency in GHz, of a polarization-reconfigurable omnidirectional DRA in both off and on states. As such, FIG. 31 shows the measured total antenna efficiency (mismatch included) of the DRA in the two operating states. With reference to FIG. 31, the average measured efficiencies in the off and on states are 63.7% and 67.0%, with peak values of 70.5% and 70.8%, respectively. The efficiency of the $TE_{011+\delta}$ mode is lower than that of the design FIG. 1 due to diode loss.

TABLE II

COMPARISON BETWEEN PROPOSED AND REPORTED DRAS

| Ref. | $f_0$/ GHz | Reconfigurable Types | Electronical Control | Antenna Efficiency | Solid DR | Size/ $\lambda_0^3$ |
|---|---|---|---|---|---|---|
| [20] | 5.5 | Frequency | Y | 54% | Y | 0.96 |
| [21] | 0.7 | Frequency | Y | 47.1-58.1% | Y | N.A. |
| [23] | 4.6 | Pattern | N | 50-80% | N | 0.54 |
| [26] | 2.5 | Polarization | N | 70% | N | 0.31 |
| [27] | 2.6 | Polarization | N | 72-74% | N | 0.54 |
| [28] | 2.4 | Polarization | N | 80% | N | 0.27 |
| [29] | 5.0 | Polarization | Y | 59-60% | N | N.A. |
| [31] | 5.5 | Pattern | Y | N.A. | N | 0.13 |
| This Work | 2.4 | Polarization | Y | 70.5-70.8% | Y | 0.06 |

$f_0$: center frequency of operating band.
$\lambda_0$: wavelength at $f_0$ in air.

Table II compares the omnidirectional DRA with other example antennas. It can be seen from the table II that the omnidirectional DRA is smallest among the various designs. Other advantages of the omnidirectional DRA is that the omnidirectional DRA has a simple structure and high switching speed. In addition, the omnidirectional DRA has stable omnidirectional radiation patterns in either polarization states.

A single-layer planar feed for exciting the $TE_{011+\delta}$ mode of a cylindrical DRA is disclosed. The omnidirectional DRA has cross-shaped printed lines, four curved arms, and four coupled strips, or eight coupled strips in some examples. The intrinsically narrow bandwidth of the $TE_{011+\delta}$ mode is greatly enhanced by using the coupled strips. To suppress the cross-polar field, four end-shorted stubs are included in the design. A prototype was fabricated and measured. The prototype measured bandwidth of 18.1% and a gain of 2.04 dBi. The measured co-polar field is stronger than the cross-polar counterpart by at least 15 dB. Based on this design, the first polarization-reconfigurable omnidirectional DRA has been designed with PIN diodes. By controlling the state of the diodes, the antenna can be operated in the $TE_{011+\delta}$ or $TM_{01\delta}$ mode, giving a horizontally or vertically polarized antenna, respectively. The measured impedance bandwidths of the $TE_{011+\delta}$ and $TM_{01\delta}$ states are 16.8% (2.18-2.58 GHz) and 16.0% (2.25-2.64 GHz), respectively. In the overlapped bandwidth (2.25-2.58 GHz), the measured antenna gains of the $TE_{011+\delta}$ and $TM_{01\delta}$ modes are 1.1 dBi and 0.62 dBi, respectively. The radiation patterns are stable in both polarization states. Finally, the antenna size is smallest among reconfigurable DRAs, making the omnidirectional DRA suitable for compact communication systems.

Figure 32:
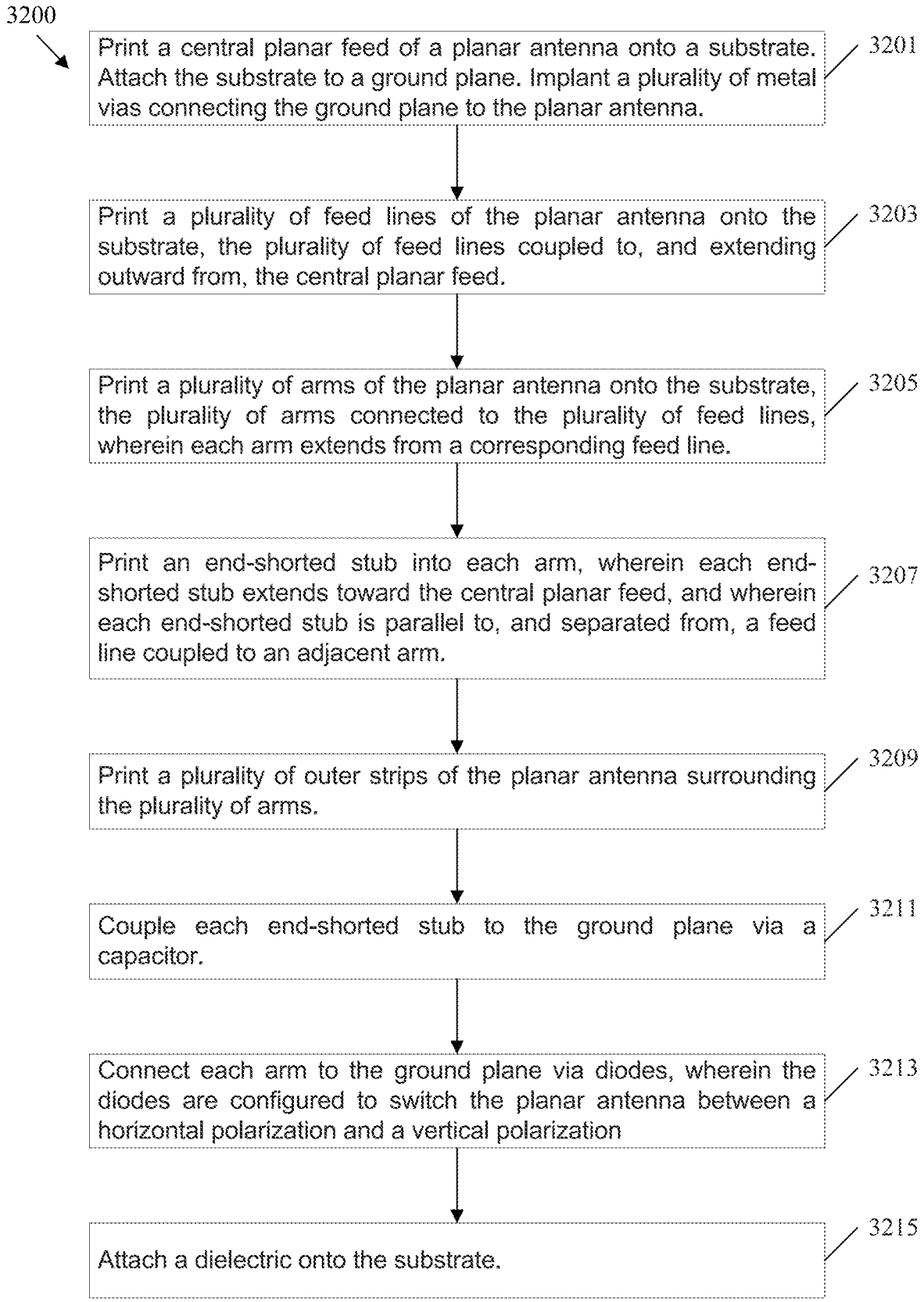
FIG. 32 is a flowchart of an example method of fabricating an omnidirectional DRA.

FIG. 32 is a flowchart of an example method of fabricating an omnidirectional DRA. At step 3201, a substrate is attached to a ground plane. A plurality of metal vias are also implanted into the substrate to connect the ground plane to a planar antenna. A central planar feed of the planar antenna is printed onto the substrate.

At step 3203, a plurality of feed lines of the planar antenna are printed onto the substrate. The plurality of feed lines coupled to, and extending outward from, the central planar feed.

At step 3205, a plurality of arms of the planar antenna are printed onto the substrate. The plurality of arms are connected to the plurality of feed lines. Each arm extends from a corresponding feed line. In an example, each arm forms an arc of a circle surrounding the central planar feed. In an example, the plurality of arms includes exactly four arms.

At step 3207, an end-shorted stub is printed into each arm. Each end-shorted stub extends toward the central planar feed. Each end-shorted stub is parallel to, and separated from, a feed line coupled to an adjacent arm.

At step 3209, a plurality of outer strips of the planar antenna are printed surrounding the plurality of arms. In an example, the plurality of outer strips includes exactly four outer strips. In an example, the plurality of outer strips forms a circle surrounding the plurality of arms. In an example, the plurality of outer strips includes exactly four outer strips. In an example, the plurality of outer strips includes four longer outer strips and four shorter outer strips (e.g., exactly eight outer strips).

At step 3211, each end-shorted stub is coupled to the ground plane via a capacitor.

At step 3213, each arm is connected to the ground plane via diodes, wherein the diodes are configured to switch the planar antenna between a horizontal polarization and a vertical polarization. In an example, each arm is connected to two diodes. In an example, each arm includes a feed end and a stub end, wherein one of the diodes connects between the ground plane and the feed end of the each arm, and wherein one of the diodes connects between the ground plane and the stub end of the each arm. In an example, the diodes and/or capacitors of steps 3211 and/or 3213 connect and/or couple the planar antenna to the ground plane using the metal vias.

At step 3215, a dielectric, such as a ceramic, is attached onto the substrate.

Having described various devices and methods, certain aspects can include, but are not limited to:

In a first aspect, an omnidirectional DRA comprises: a substrate; a dielectric; and a planar antenna positioned between the substrate and the dielectric, the planar antenna comprising: a central planar feed positioned on the substrate; a plurality of feed lines coupled to, and extending outward from, the central planar feed; and a plurality of arms coupled to the plurality of feed lines, wherein each arm extends from a corresponding feed line.

A second aspect can include the omnidirectional DRA of the first aspect, wherein each arm forms an arc of a circle surrounding the central planar feed.

A third aspect can include the omnidirectional DRA of any of the first aspect through the second aspect, wherein the plurality of arms includes exactly four arms.

A fourth aspect can include the omnidirectional DRA of any of the first aspect through the third aspect, wherein each arm comprises an end-shorted stub extending toward the central planar feed, and wherein each end-shorted stub is parallel to, and separated from, a feed line coupled to an adjacent arm.

A fifth aspect can include the omnidirectional DRA of any of the first aspect through the fourth aspect, wherein the planar antenna further comprises a plurality of outer strips surrounding the plurality of arms.

A sixth aspect can include the omnidirectional DRA of any of the first aspect through the fifth aspect, wherein the plurality of outer strips are coupled to, but not directly connected to, the plurality of arms.

A seventh aspect can include the omnidirectional DRA of any of the first aspect through the sixth aspect, wherein the plurality of outer strips includes exactly four outer strips.

An eighth aspect can include the omnidirectional DRA of any of the first aspect through the sixth aspect, wherein the plurality of outer strips includes four longer outer strips and four shorter outer strips.

A ninth aspect can include the omnidirectional DRA of any of the first aspect through the eighth aspect, wherein the plurality of outer strips forms a circle surrounding the plurality of arms.

A tenth aspect can include the omnidirectional DRA of any of the first aspect through the ninth aspect, further comprising a ground plane, wherein the substrate is positioned between the planar antenna by the ground plane.

An eleventh aspect can include the omnidirectional DRA of any of the first aspect through the tenth aspect, further comprising a plurality of diodes, wherein each arm is connected to two diodes.

A twelfth aspect can include the omnidirectional DRA of any of the first aspect through the eleventh aspect, wherein each arm includes a feed end and a stub end, wherein one of the diodes connects between the ground plane and the feed end of the each arm, and wherein one of the diodes connects between the ground plane and the stub end of the each arm.

A thirteenth aspect can include the omnidirectional DRA of any of the first aspect through the twelfth aspect, wherein the diodes are configured to switch the planar antenna between a horizontal polarization (e.g., $TE_{011+\delta}$ mode) and a vertical polarization (e.g., $TE_{01\delta}$ mode).

A fourteenth aspect can include the omnidirectional DRA of any of the first aspect through the thirteenth aspect, further comprising a plurality of capacitors, wherein each arm comprises an end-shorted stub, and wherein each capacitor connects between the ground plane and a corresponding end-shorted stub.

A fifteenth aspect can include the omnidirectional DRA of any of the first aspect through the fourteen aspect, wherein the substrate comprises a plurality of metal vias connecting the ground plane to the planar antenna.

In a sixteenth aspect, a method of fabricating an omnidirectional DRA comprises: printing a central planar feed of a planar antenna onto a substrate; printing a plurality of feed lines of the planar antenna onto the substrate, the plurality of feed lines coupled to, and extending outward from, the central planar feed; printing a plurality of arms of the planar antenna onto the substrate, the plurality of arms connected to the plurality of feed lines, wherein each arm extends from a corresponding feed line; and attaching a dielectric onto the substrate.

A seventeenth aspect can include the method of the sixteenth aspect, wherein each arm forms an arc of a circle surrounding the central planar feed.

An eighteenth aspect can include the method of any of the sixteenth aspect through the seventeenth aspect, wherein the plurality of arms includes exactly four arms.

A nineteenth aspect can include the method of any of the sixteenth aspect through the eighteenth aspect, further comprising printing an end-shorted stub into each arm, wherein each end-shorted stub extends toward the central planar feed, and wherein each end-shorted stub is parallel to, and separated from, a feed line coupled to an adjacent arm.

A twentieth aspect can include the method of any of the sixteenth aspect through the nineteenth aspect, further comprising printing a plurality of outer strips of the planar antenna surrounding the plurality of arms.

A twenty first aspect can include the method of any of the sixteenth aspect through the twentieth aspect, wherein the plurality of outer strips are coupled to, but not directly connected to, the plurality of arms.

A twenty second aspect can include the method of any of the sixteenth aspect through the twenty first aspect, wherein the plurality of outer strips includes exactly four outer strips or exactly eight outer strips.

A twenty third aspect can include the method of any of the sixteenth aspect through the twenty first aspect, wherein the plurality of outer strips forms a circle surrounding the plurality of arms.

A twenty fourth aspect can include the method of any of the sixteenth aspect through the twenty third aspect, further comprising attaching the substrate to a ground plane; and coupling each end-shorted stub to the ground plane via a capacitor.

A twenty fifth aspect can include the method of any of the sixteenth aspect through the twenty fourth aspect, further comprising attaching the substrate to a ground plane; and connecting each arm to the ground plane via diodes, wherein the diodes are configured to switch the planar antenna between a horizontal polarization and a vertical polarization.

A twenty sixth aspect can include the method of any of the sixteenth aspect through the twenty fifth aspect, wherein each arm is connected to two diodes.

A twenty seventh aspect can include the method of any of the sixteenth aspect through the twenty sixth aspect, wherein each arm includes a feed end and a stub end, wherein one of the diodes connects between the ground plane and the feed end of the each arm, and wherein one of the diodes connects between the ground plane and the stub end of the each arm.

A twenty eighth aspect can include the method of any of the sixteenth aspect through the twenty seventh aspect, further comprising implanting a plurality of metal vias connecting the ground plane to the planar antenna.

A twenty ninth aspect can include the method of any of the sixteenth aspect through the twenty eighth aspect, wherein the diodes and/or capacitors connect and/or couple the planar antenna to the ground plane using the metal vias.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An omnidirectional dielectric resonator antenna (DRA) comprising:

a substrate;

a dielectric; and a planar antenna positioned between the substrate and the dielectric, the planar antenna comprising:

a central circular patch positioned on the substrate;

a plurality of feed lines coupled to, and extending outward from, the central circular patch; and a plurality of arms coupled to the plurality of feed lines, wherein each arm extends from a corresponding one of the feed lines.

2. The omnidirectional DRA of claim 1, wherein each arm forms an arc of a circle surrounding the central circular patch.

3. The omnidirectional DRA of claim 1, wherein the plurality of arms includes exactly four arms.

4. The omnidirectional DRA of claim 1, wherein each of the arms comprises an end-shorted stub extending toward the central circular patch, and wherein each end-shorted stub is parallel to, and separated from, a respective one of the feed lines coupled to a respective one of the arms.

5. The omnidirectional DRA of claim 1, wherein the planar antenna further comprises a plurality of outer strips surrounding the plurality of arms.

6. The omnidirectional DRA of claim 5, wherein the plurality of outer strips are coupled to, but not directly connected to, the plurality of arms.

7. The omnidirectional DRA of claim 5, wherein the plurality of outer strips includes exactly four outer strips.

8. The omnidirectional DRA of claim 5, wherein the plurality of outer strips includes four longer outer strips and four shorter outer strips.

9. The omnidirectional DRA of claim 5, wherein the plurality of outer strips forms a circle surrounding the plurality of arms.

10. The omnidirectional DRA of claim 1, further comprising a ground plane, wherein the substrate is positioned between the planar antenna by the ground plane.

11. The omnidirectional DRA of claim 10, further comprising a plurality of diodes, wherein each arm is connected to two diodes.

12. The omnidirectional DRA of claim 11, wherein each arm includes a feed end and a stub end, wherein one of the diodes connects between the ground plane and the feed end of the each arm, and wherein one of the diodes connects between the ground plane and the stub end of the each arm.

13. The omnidirectional DRA of claim 11, wherein the diodes are configured to switch the planar antenna between a horizontal polarization and a vertical polarization.

14. The omnidirectional DRA of claim 10, further comprising a plurality of capacitors, wherein each arm comprises an end-shorted stub, and wherein each capacitor connects between the ground plane and a corresponding end-shorted stub.

15. The omnidirectional DRA of claim 10, wherein the substrate comprises a plurality of metal vias connecting the ground plane to the planar antenna.

16. A method of fabricating an omnidirectional dielectric resonator antenna (DRA) comprising:

printing a central circular patch of a planar antenna onto a substrate;

printing a plurality of feed lines of the planar antenna onto the substrate, the plurality of feed lines coupled to, and extending outward from, the central circular patch;

printing a plurality of arms of the planar antenna onto the substrate, the plurality of arms connected to the plurality of feed lines, wherein each arm extends from a corresponding one of the feed lines; and attaching a dielectric onto the substrate.

17. The method of claim 16, further comprising printing an end-shorted stub into each of the arms, wherein each end-shorted stub extends toward the central circular patch, and wherein each end-shorted stub is parallel to, and separated from, a respective one of the feed line coupled to a respective one of the arms.

18. The method of claim 17, further comprising:

attaching the substrate to a ground plane; and coupling each end-shorted stub to the ground plane via a capacitor.

19. The method of claim 16, further comprising printing a plurality of outer strips of the planar antenna surrounding the plurality of arms.

20. The method of claim 16, further comprising:

attaching the substrate to a ground plane; and connecting each arm to the ground plane via diodes, wherein the diodes are configured to switch the planar antenna between a horizontal polarization and a vertical polarization.

* * * * *